US005382325A

United States Patent [19]

Warda et al.

[11] Patent Number: 5,382,325

[45] Date of Patent: Jan. 17, 1995

[54] METHOD AND APPARATUS FOR MANUFACTURING DUNNAGE MATERIAL

[75] Inventors: Thomas S. Warda, Aurora; Bernard J. Karnowka, Bailey, both of Colo.

[73] Assignee: Envirocube, Inc., Denver, Colo.

[21] Appl. No.: 33,134

[22] Filed: Mar. 18, 1993

Related U.S. Application Data

[63] Continuation-in-part of Ser. No. 819,764, Jan. 13, 1992, abandoned.

[51] Int. Cl.[6] ..... D21F 13/00

[52] U.S. Cl. ..... 162/218; 162/101; 162/230; 162/410

[58] Field of Search ..... 162/230, 218, 387, 410, 162/231, 101, 208; 264/86, 87; 425/84, 85; 428/369; 206/814, 584

[56] References Cited

U.S. PATENT DOCUMENTS

| | | | |
|---|---|---|---|
| 1,872,533 | 8/1932 | Von Hildebrandt | 162/101 |
| 2,579,036 | 12/1951 | Edelman | 154/44 |
| 3,933,959 | 1/1956 | Skochdopole | 264/45.5 |
| 4,621,022 | 11/1986 | Kohaut et al. | 428/397 |
| 4,997,091 | 3/1991 | McCrea | 206/584 |

*Primary Examiner*—W. Gary Jones
*Assistant Examiner*—Brenda Adele Lamb
*Attorney, Agent, or Firm*—Donald R. Comuzzi; Christopher L. Makay

[57] ABSTRACT

A method and apparatus for forming articles, used as dunnage material, from pulped paper products includes a paper shredder that forms the pulped paper and delivers it to a slurry tank. The slurry tank gravity feeds the slurry into a slurry reservoir where a pump pumps the slurry into molds. A plunger delivers compressed air to the slurry blobs contained within each molds to expand the slurry blobs to the shape of the molds and to force the water in the slurry through an outlet in the bottom of the molds to a vacuum chamber connected to the molds. The delivery of compressed air further forms a cavity within the expanded slurry blobs. During the next four steps, the molds again connect to the vacuum so that additional water is forced from the pulp into the vacuum chamber. Finally, an ejector supplies compressed air to the bottom of the molds such that the finished articles are propelled from the molds onto a conveyor which delivers the cubes to packaging machines.

1 Claim, 12 Drawing Sheets

METHOD AND APPARATUS FOR MANUFACTURING DUNNAGE MATERIAL

REFERENCES TO RELATED APPLICATIONS

This application is a continuation-in-part application of application Ser. No. 07/819,764, filed Jan. 13, 1992, now abandoned.

BACKGROUND OF THE INVENTION

1. Field of the Invention

The present invention relates to articles which may be used as dunnage material and, more particularly, but not by way of limitation, to a method and apparatus for manufacturing the articles utilizing biodegradable, recyclable material.

2. Description of the Related Art

Packaging material is a necessity because a large percentage of shipped goods require protection during transportation. For example, certain goods such as glass, clocks, lamps, crystal, and china are extremely delicate and, therefore, require careful handling and packaging to avoid damage during transport. Furthermore, even goods which are less delicate such as books often need special packaging to prevent damage during shipping. Accordingly, many shipped goods are packed in a dunnage material which acts as a lightweight, shock absorbing cushion to prevent those goods from being damaged during transit.

The most common dunnage material in use today comprises pellets formed from foamed polymerized plastics such as polystyrene. The foamed plastic pellets are typically fabricated in a variety of configurations, such as concave disks, peanut shapes, and clover leaf structures, in order to produce a shock absorbing effect. Specifically, the odd configurations of the foamed plastic pellets produce shock absorbing air spaces between them when they are packed about a good placed in a shipping container. That is, if a force is exerted against the shipping container, the air spaces between the pellets absorb the shock, thereby preventing damage to the shipped good.

Although foamed plastic pellets provide effective dunnage material because they are lightweight, resilient, and shock absorbing, they suffer disadvantages which makes their use undesirable. First, foamed plastic pellets are bulky, thus making their storage and shipment before use burdensome and uneconomical. That is, the containers required to store and transport large amounts of the foamed plastic pellets are either unnecessarily large or extremely numerous. Second, foamed plastic pellets exhibit static forces that cause them to cling to one another. As a result, the foamed plastic pellets agglomerate to disrupt the operation of automatic dunnage dispensing machines. Third, foamed plastic pellets are environmentally unsound because they are fabricated from non-renewable resources which do not safely biodegrade. Accordingly, both the production and subsequent disposal of foamed plastic pellets result in damage to the environment. Finally, foamed plastic pellets fabricated from polystyrene are highly flammable and, therefore, present a significant fire hazard.

A specific example of foamed plastic pellets utilized as dunnage material is disclosed in U.S. Pat. No. 4,621,022, issued on Nov. 4, 1986 to Kohaut et al. Kohaut et al. disclose a packing material constructed from a foamed plastics granular material. The foamed plastics granular material is shaped into particles which form a star-shaped basic body having at least one orifice and at least three limbs lying in a common plane.

Another example of a synthetic dunnage material is disclosed in U.S. Pat. No. 2,579,036, issued on Dec. 18, 1951 to Edelman. Edelman discloses a prefabricated packing briquette that is formed of synthetic fibers impregnated with a water proof binder such as a vulcanized rubber adhesive. Although the dunnage material disclosed in Edelman is useful for insulating purposes and for padding furniture, it is not well adapted for packaging objects for shipment because of its weight.

Although the majority of dunnage material is formed from foamed polymerized plastics, it may also be fabricated from paper products. An example of paper dunnage material is disclosed in U.S. Pat. No. 4,997,091, issued Mar. 5, 1991 to McCrea. McCrea discloses a free flowing dunnage packing material formed in small pellet-like particles from recycled scrap paper. The dunnage material is formed by first mixing paper and heated water to produce a pulp, and then extruding the pulp fiber for fabrication into the small pellet-like particles. Unfortunately, production of dunnage material of this type is expensive as well as labor intensive.

Furthermore, solid particulate dunnage material is unacceptable for protecting delicate goods because it permits a shipped good to move about its packaging container during transport. Movement of the shipped good about its packaging container may be prevented by tightly packing the solid particulates around the good. However, any tight packing of the solid particulates results in their directly transmitting any jarring forces to the packed good rather than their absorbing the impact. Thus, damage to the shipped good may occur even though it is prevented from moving about the packaging container.

In addition, waste paper used in making the dunnage material often has printing on it which tends to come off on the packed good or on the person packing or unpacking the shipped good. Also, because the dunnage particles are solid, they are relatively heavy which makes their use in packaging goods for shipping economically inefficient.

Moreover, similar to foamed plastic pellets, solid paper particulate dunnage material is bulky which causes its shipping before use both difficult and uneconomical. That is, solid paper particulate dunnage material also fails to overcome the problems of pre-use shipping experienced by foamed plastic pellets. Essentially, the solid particulates are difficult and clumsy to ship because they are formed in uneven and unstackable shapes. Thus, the boxes in which the solid particulates are shipped are either unnecessarily large or exceptionally numerous. Accordingly, although the solid paper particulates do have the advantage of being biodegradable, their disadvantages make them inadequate as a dunnage material.

The present invention, therefore, sets forth a method and apparatus for manufacturing an article suitable for use as a dunnage material which improves over foamed plastic and solid paper particulate dunnage materials by being recyclable, biodegradable, and formed into hollow shapes which allow even stacking so that economical pre-use shipping may be accomplished.

SUMMARY OF THE INVENTION

The articles manufactured utilizing the method and apparatus according to the present invention find their primary use as dunnage material. A pulped paper slurry created from scrap paper products forms the articles. Once fabricated, the articles may be placed within a container around an object to be shipped to prevent the object from moving about the container and, further, to absorb any shocks exerted against the container during its transport.

Although the articles perform a similar function as currently available dunnage material, they offer significant advantages over current dunnage materials. First, the articles are safer for the environment. That is, not only does a renewable source material form the articles, but also that source material comprises a scrap material which is considered waste and, otherwise, would most likely end up in a sanitary land fill. Accordingly, the articles themselves are recyclable because they are made from recyclable materials. Furthermore, even if the articles end up in a sanitary landfill, they are biodegradable.

Second, symmetric geometric shapes constitute the articles to permit easy stacking and arranging for shipping to persons requiring dunnage material. Illustratively, if cubes comprise the articles, those cubes may be packaged in stacked rows that maximize the number of cubes shipped, thereby eliminating the problems found in the shipment of current dunnage materials.

Finally, the hollow construction of the articles makes them lightweight, resilient, and shock absorbing. As in currently available dunnage materials, when the articles are placed within a container about an object, space between each of the articles exists which is used to absorb any shock exerted against the container. Unfortunately, in some instances, if the container experiences an exceptionally large blow, the spaces may not be enough to absorb all the force, thereby allowing some shock to be transmitted to the object possibly causing damage. However, the articles of the present invention will not transfer the shock to the shipped object due to their hollow construction. That is, rather than transfer the shock to the shipped object, the cubes themselves will crush to absorb the shock and prevent damage to the shipped object.

To form the above-described articles, a pulped paper slurry must first be created. A paper shredder which communicates at one end with a paper source and at its opposite end with a slurry tank forms the slurry. High pressure nozzles mounted on the paper shredder deliver water to the inside of the paper shredder. Consequently, the nozzles connect to a water supply tank, which, in turn connects to a water source. Additionally, a pair of screens mount within the paper shredder to shred the paper delivered to the inside of the paper shredder by the paper source. Thus, in operation, as the paper source feeds scrap paper into the paper shredder, the nozzles inject water into the inside of the paper shredder. The nozzles inject the water into the paper shredder with sufficient force to propel the paper through the screens. That forcing of the paper through the screens, shreds the paper into small particulates which form a consistent paste with the water. The paste then empties from the paper shredder into the pulp tank to become the pulped paper slurry.

Although the water retains the shredded paper in the slurry solution and, also, assists in moving the slurry to the molds, the shredding of the paper requires more water than is necessary to deliver the slurry to a plurality of molds utilized to form the article. As a result, a portion of the water separates from the slurry. The slurry settles on the bottom of the slurry tank while the separated water rises over top of the slurry. Accordingly, a slurry tank pump removes the separated water from the slurry tank and delivers it back to the water supply tank.

In addition to allowing the excess water to be removed from the slurry, the slurry tank gravity feeds the slurry into a mixer which constantly agitates it to produce a slurry having a more consistent viscosity. A mixer pump then pumps the agitated slurry to a slurry reservoir so that a slurry pump can pump the slurry to the molds through a plurality of tubes. The slurry reservoir communicates with one end of the plurality of tubes, while the opposite ends of the tubes mount over a mold wheel to deliver slurry into the individual molds. The mold wheel comprises a plurality of mold rows that consist of a plurality of individual molds. The article forming apparatus of the present invention forms the articles in a series of steps that begin with the delivery of slurry into the molds of one of the mold rows which comprise the mold wheel.

A mold wheel drive connects to the mold wheel to drive the mold wheel in a step-wise manner so that each of the mold rows that comprise the mold wheel are subjected to the article forming process. Thus, after the molds of a mold wheel row receive slurry from the tubes, the mold wheel drive indexes the mold wheel one position so that the mold row which just received the slurry resides below a plunger. At this point, a plunger drive drives the plunger over the molds of the mold row such that needles protruding from the plunger fit into the slurry within each mold. A source of pressurized air then delivers compressed air into the center of the blob of slurry within the molds, resulting in the slurry being expanded into the shape defined by the molds. As the slurry blobs expand, voids form within their centers. Simultaneously, the bottoms of each mold couple to a vacuum chamber. Thus, in addition to expanding the slurry, the compressed air forces water from the slurry into the water vacuum. After the slurry fully expands and sufficient water has been removed to ensure the slurry will retain its void, the plunger drive pulls the plunger from the mold row, and the mold wheel drive indexes the mold row to the next position.

At the next position and the following three positions reached through the indexing of the mold wheel by the mold wheel drive, the mold row again couples to the vacuum chamber so that additional water will be drawn from the expanded slurry. During the mold rows connection to the vacuum chamber at each of the four positions, the expanded slurry within each of the molds experiences sufficient water removal so that they will retain their shape when ejected from the molds. After the fourth position, the mold wheel drive indexes the mold wheel such that the mold row resides between an ejector. The ejector substitutes the source of pressurized air for the vacuum chamber. As a result, compressed air enters the bottom of the molds to propel the articles from the molds onto a conveyor which conveys the articles to the packaging apparatus where the articles are packaged for shipping. Although the article formation steps were described sequentially, the article forming apparatus performs each step concurrently because one of the plurality of mold rows always is subjected to one of the above-described article forming steps.

It is, therefore, an object of the present invention to provide a method and apparatus for producing an article which may be used as a light weight, biodegradable, and recyclable dunnage material.

It is a further object of the present invention to provide a method and apparatus that cheaply and efficiently creates a pulped paper slurry.

It is another object of the present invention to provide a method and apparatus to manufacture resilient, shock absorbing dunnage material employing both an air space between individual dunnage articles and an air space within each individual dunnage article.

It is still another object of the present invention to provide a method and apparatus to manufacture a dunnage material that can be uniformly packed into a relatively small container for shipment from the manufacturer to the packaging user.

It is still a further object of the present invention to provide a method and apparatus for manufacturing a dunnage material which is lightweight yet pourable into a container containing a packed object without the build up of disruptive static electricity.

It is yet another object of the present invention to provide a method and apparatus for manufacturing a dunnage material that absorbs liquids which may spill or leak from stored or shipped containers.

Still other objects, features, and advantages of the present invention will become evident to those skilled in the art in light of the following.

DETAILED DESCRIPTION OF THE PREFERRED EMBODIMENT

Figure 1:
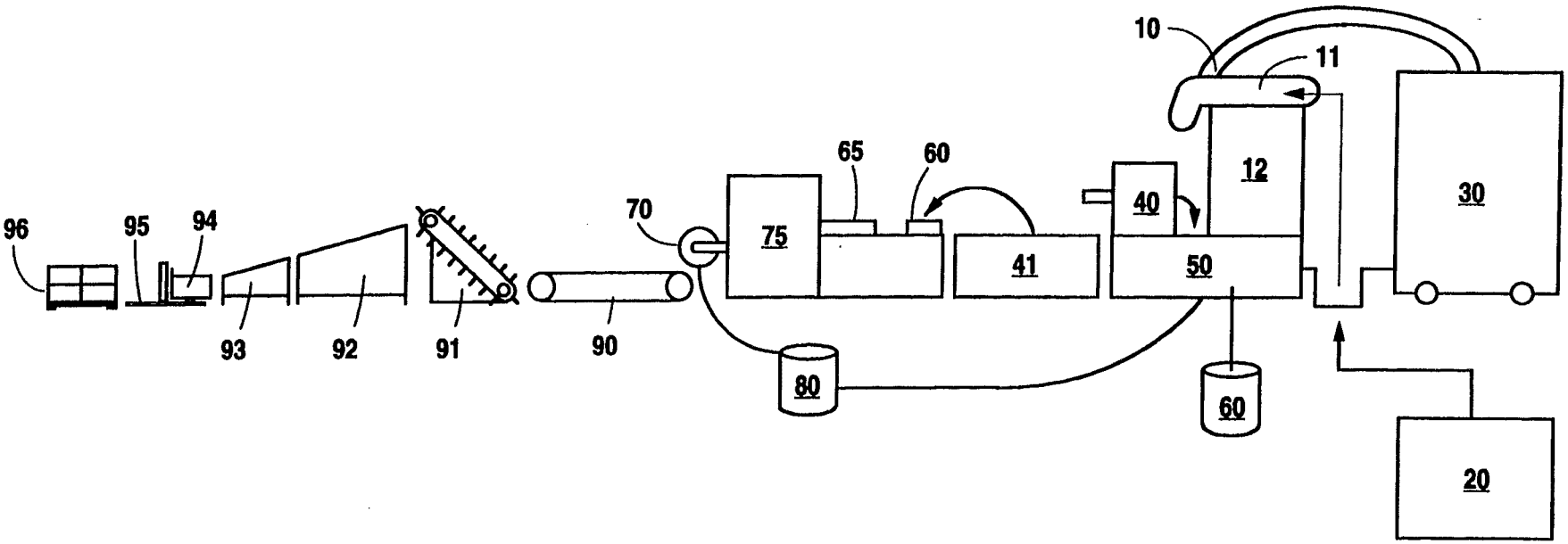
FIG. 1 is a schematic diagram depicting the paper shredding apparatus and the article forming apparatus according to the preferred embodiment of the present invention.
Figure 2:
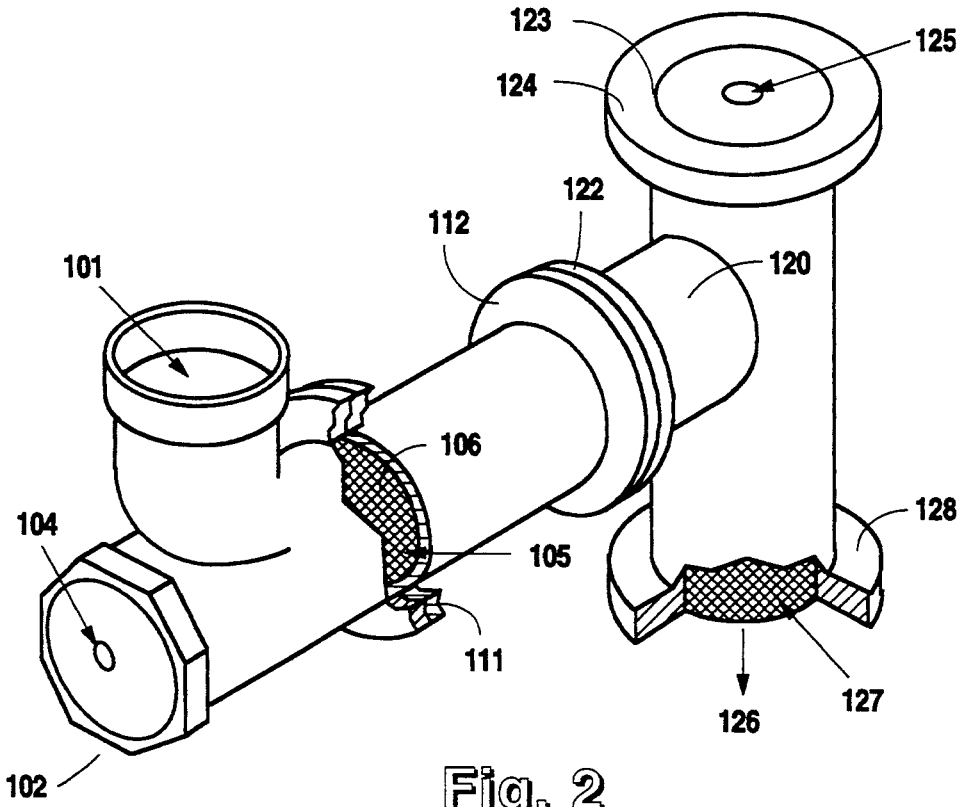
FIG. 2 is a perspective view depicting a first embodiment of the mixing chamber of the paper shredding apparatus of the present invention.
Figure 3:
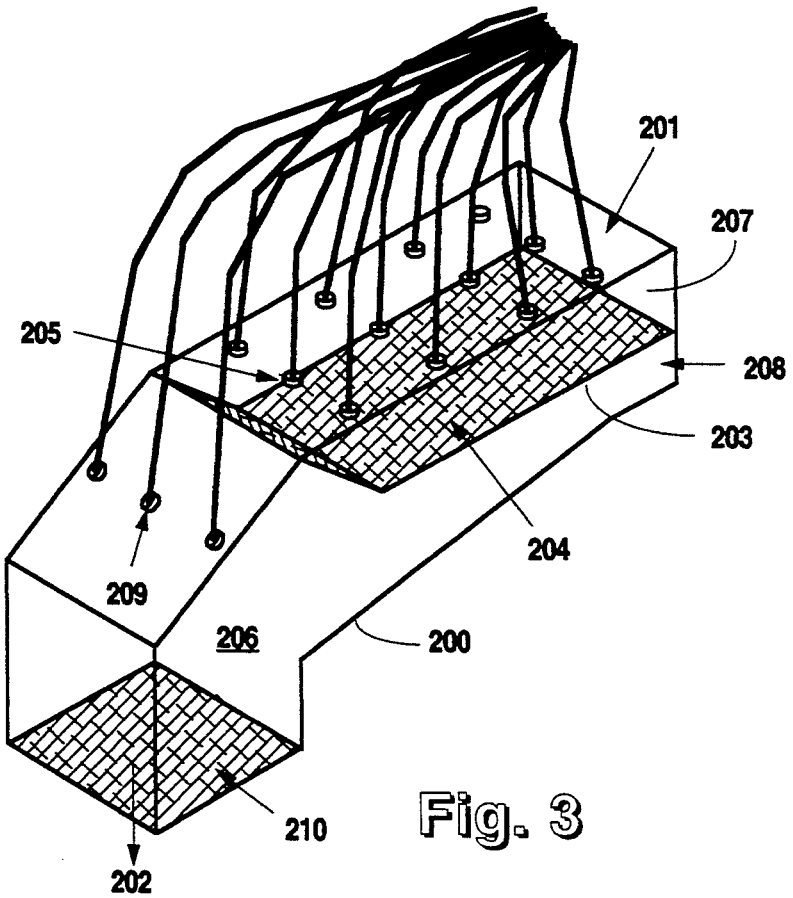
FIG. 3 is a perspective view depicting a second embodiment of the mixing chamber of the paper shredding apparatus of the present invention.

Referring to FIGS. 1–3, the apparatus according to the preferred embodiment of the present invention for preparing the pulped paper slurry will be described. Shredder 10 comprises mixing chamber 11 mounted on base 12. Mixing chamber 11 communicates at one inlet with paper source 20 and at a plurality of other inlets with a pair of pumps (not shown) mounted on pump cart 30. The outlet of mixing chamber 11 communicates with slurry tank 40. The pumps mounted on pump cart 30 communicate with water supply tank 50 to furnish the water to mixing chamber 11 which is necessary to create the pulped paper slurry. Water supply tank 50 receives water from water source 60, which in the preferred embodiment is a municipal water line. Water source 60 initially fills water supply tank 50 and, then, periodically refills it when the water level in water supply tank 50 reaches a specified minimum level. However, water supply tank 50 also communicates with slurry tank 40 and vacuum tank 80 in order to receive water reclaimed during the forming of the article (described herein). The reclamation of water (approximately 95%) allows a limited amount of water to produce a large amount of slurry used to form the article.

As shown in FIG. 2, a first embodiment of mixing chamber 11 comprises inlet tube 100, connector tube 110, and outlet tube 120. The t-shaped configurations of tubes 100 and 120 provide them with two inlets and one outlet. Inlet 101 of tube 100 communicates with paper source 20 and functions as the paper feed. Paper may be fed into inlet 101 from paper source 20 either manually or automatically through a conveyor belt. Inlet 102 serves as a water inlet. Cap 103 seals inlet 102, however, nozzle 104 fluidly communicates with a first pump mounted on pump cart 30 to inject water into tube 100 under high pressure.

Flange 105 of tube 100 and flange 111 of tube 110 connect together to couple the outlet of tube 100 to the inlet of tube 110. Flanges 105 and 111 position adjacent to one another and connect together using any conventional means such as nuts and bolts or glue. Flanges 105 and 111 perform the additional function of securing screen 106 within the passageway created by the coupling of tube 100 to tube 110. In the preferred embodiment, screen 106 comprises a coarse screen that initially shreds the paper fed into tube 100 from paper source 20.

The outlet of tube 110 connected to inlet 121 of tube 120 using flanges 112 and 122 and the same procedure employed to connect flanges 105 and 111 together. Inlet 122 provides a passageway from tube 100 into tube 120, while inlet 123 furnishes a second water inlet. Cap 124 seals inlet 123, however, nozzle 125 fluidly communicates with the second pump mounted on pump cart 30 to inject water into tube 120 under high pressure. Screen 127 mounts within cap 128, and cap 128 threadably connects to tube 120 to secure screen 127 against the end of tube 120 and over outlet 126. Screen 127 comprises a fine screen so that the coarsely shredded paper will be reduced to a fine pulp.

During operation, as paper feeds into tube 100 through inlet 101, nozzle 104 injects high pressure water into tube 100. The high pressure water forces the paper through screen 106, resulting in the paper shredding into coarse particles. Additionally, the high pressure water propels the coarsely shredded paper particles from tube 110 into tube 120 through inlet 121. As the coarsely shredded paper enters tube 120, nozzle 125 injects a second high pressure water stream which drives the coarsely shredded particles through screen 127. Screen 127 further shreds the coarsely shredded particles into a fine pulp. Outlet 126 directs the fine pulp and water into slurry tank 40 to create the pulped paper slurry used to form the article.

As shown in FIG. 3, the second embodiment of mixing chamber 11 comprises enclosure 200 having inlet 201 and outlet 202. Screen 203 removably mounts using any suitable means such as screws or nuts and bolts along the sidewalls of enclosure 200 and at one end to the top of enclosure 200. Screen 203 divides enclosure 200 into chambers 204 and 206 and inlet 201 into upper inlet 207 and lower inlet 208. Screen 203 comprises a coarse screen that initially shreds the paper delivered into enclosure 200 from paper source 20 into coarse particles. A first set of nozzles 205 threadably connect to the top of enclosure 200 and communicate with the first pump mounted on pump cart 30 to inject water under high pressure into chamber 204. Furthermore, a second set of nozzles 209 threadably connect to the top of enclosure 200 and communicate with the second pump mounted on pump cart 30 to inject water under high pressure into the area of chamber 206 which encompasses outlet 202. Screen 210 removably mounts over outlet 202 using any suitable means such as screws or nuts and bolts. Screen 210 comprises a fine screen so that the coarsely shredded paper entering chamber 206 will be reduced to a fine pulp.

During operation, as paper feeds into chamber 204 from paper source 20, nozzles 205 inject water into chamber 204. The high pressure water forces the paper through screen 203, resulting in the paper shredding into coarse particles. Additionally, the high pressure water propels the coarsely shredded paper particles from chamber 204 into chamber 206. Upper inlet 207 may be fed from paper source 20 either manually or automatically through a conveyor belt. As the coarsely shredded paper enters chamber 206, nozzles 209 inject a second high pressure water stream which drives the coarsely shredded particles through screen 210. Furthermore, lower inlet 208 communicates with a water source, which may either the pumps on pump cart 30 or a third pump, to supply a water stream that aids in the movement of the coarsely shredded paper particles to screen 210. Screen 210 further shreds the coarsely shredded particles into a fine pulp. Outlet 202 directs the fine pulp and water into slurry tank 40 to create the pulped paper slurry used to form the article.

After mixing chamber 11 delivers the pulped paper slurry into slurry tank 40, pump 65 (described herein) ultimately pumps the slurry to the molds (described herein) utilized to form the article. However, shredding the paper requires more water than is necessary to maintain the pulped paper in a slurry suitable to make the article. Thus, although the water and pulped paper initially enter slurry tank 40 as a complete slurry, after a short time period, a majority of the water separates from the pulped paper. Specifically, due to the difference between the specific gravity's of the pulped paper and the water, the pulped paper migrates to the bottom of slurry tank 40, while the water separates out and accumulates over the remaining slurry. At this point, a pump (not shown) pumps the excess water from slurry tank 40 into water supply tank 50 because that water is not required to move the remaining slurry to the molds used in constructing the article. A filter connects to the pump (not shown) to ensure the pump draws no slurry from slurry tank 40 into water supply tank 50. After return to water supply tank 50, the pumps mounted of pump cart 30 pump the reclaimed water to mixing chamber for reuse in the shredding process described above.

Referring again to FIG. 1 and to FIGS. 4–7 and 22, the transfer of the slurry to the molds for making the article will be described. Slurry tank 40 transfers the slurry into mixer 41 (see FIGS. 1 and 22). That is, slurry tank 40 gravity feeds the slurry to mixer 41 through outlet 45 by virtue of its position above mixer 41. Mixer 41 constantly agitates the slurry to produce a slurry having a more consistent viscosity.

Figure 22:
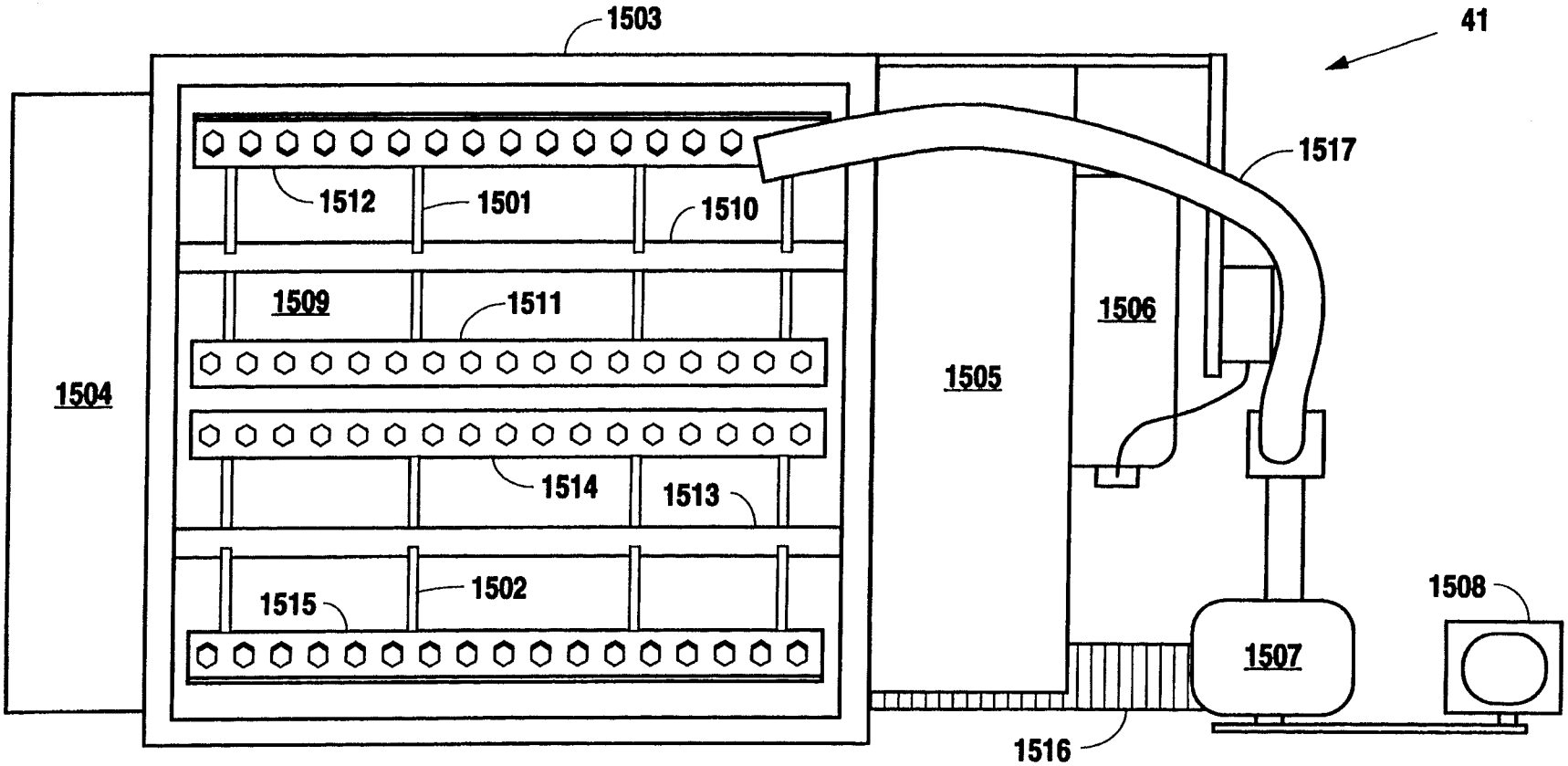
FIG. 22 is a top view depicting the mixer of the article forming apparatus of the present invention.

As shown in FIG. 22, mixer 41 comprises agitators 1501 and 1502, mixing chamber 1503, gear boxes 1504 and 1505, motor 1506, pump 1507, and pump motor 1508. Mixing chamber 1503 receives the slurry from slurry tank 40 through opening 1509 and functions to hold the slurry for agitation by agitators 1501 and 1502. Agitators 1501 includes shaft 1510, paddle blades 1511 and 1512, and a third paddle blade (not shown). Similarly, agitator 1502 includes shaft 1513, paddle blades 1514 and 1515, and a third paddle blade (not shown). Shafts 1510 and 1513 rotatably mount agitators 1501 and 1502 within mixing chamber 1503 using any suitable means such as bearings mounted to the walls of mixing chamber 1503. Gear boxes 1504 and 1505 each include two gears (not shown); one mounted to shaft 1510 and the other mounted to shaft 1513. Furthermore, the two gears within each of gear boxes 1504 and 1505 mesh so that agitators 1502 and 1503 may be driven synchronously. Motor 1506 connects to any suitable power source such as a wall socket and, further, attaches to one of the gears of gear box 1505 using a drive shaft (not shown). Motor 1506 rotatably drives agitators 1501 and 1502 so that their paddle blades will mix and agitate the slurry within mixing chamber 1503, thereby producing a slurry having a more consistent viscosity. Pump 1507 communicates with mixing chamber 1503 via hose 1516 to pump the agitated slurry to slurry reservoir 60 (see FIGS. 1 and 4) via hose 1517. Pump motor 1508 drives pump 1507 and may be actuated either manually or using a relay connected to a slurry viscosity sensor within mixing chamber 1503.

Figure 4:
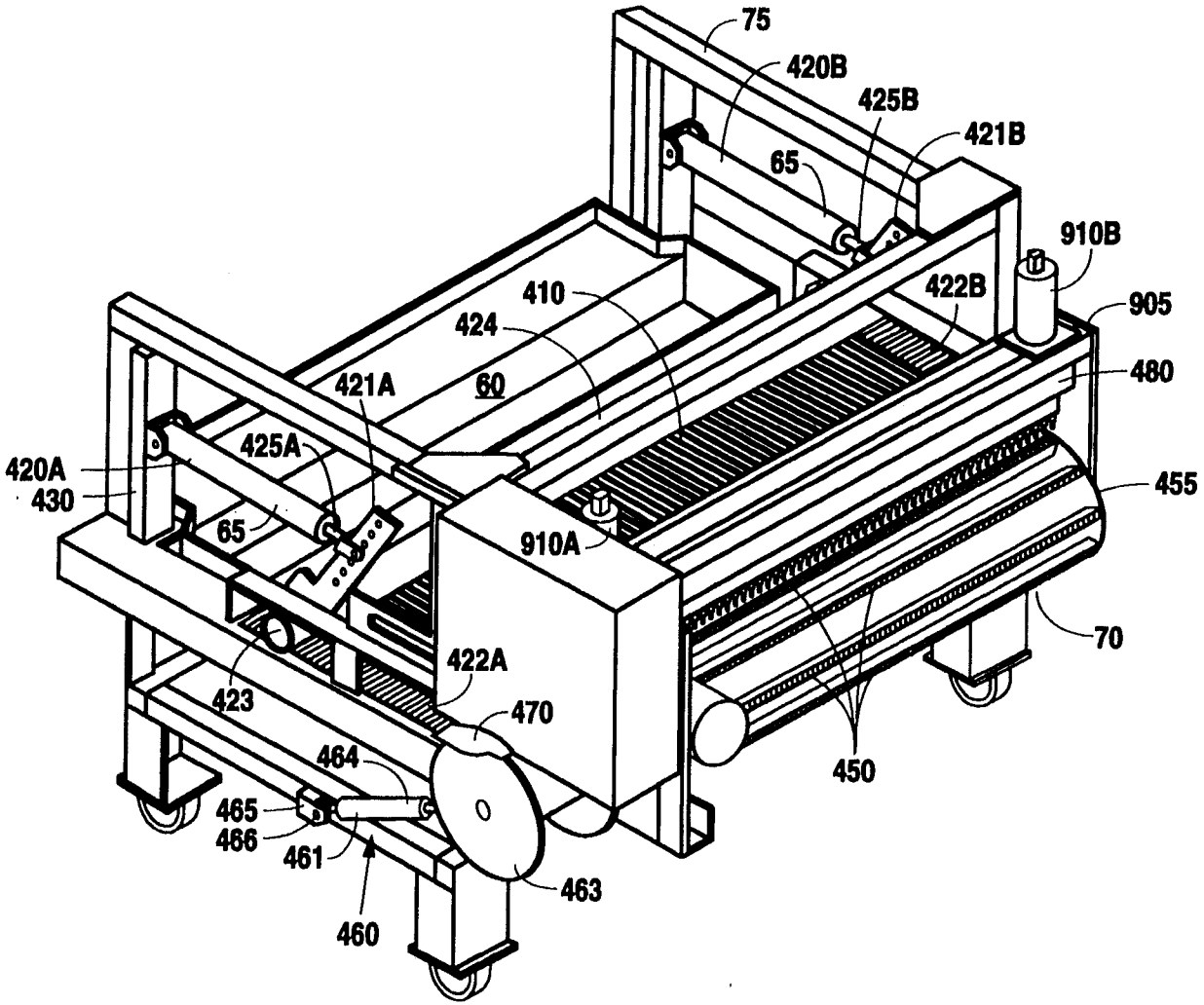
FIG. 4 is a perspective view depicting the article forming apparatus according to the preferred embodiment of the present invention.

Slurry reservoir 60 mounts onto frame 75 using any suitable means such as welding or screws (see FIG. 4). After pump 11507 pumps the agitated slurry into slurry reservoir 60, pump 65 pumps the slurry from slurry reservoir 60 to the molds which comprise mold wheel 70 through a plurality of tubes 410 (50 in the preferred embodiment). Tubes 410 communicate at their inlets with slurry reservoir 60 and at their outlets with the molds that comprise mold wheel 70 to deliver the slurry into the molds.

Figure 5:
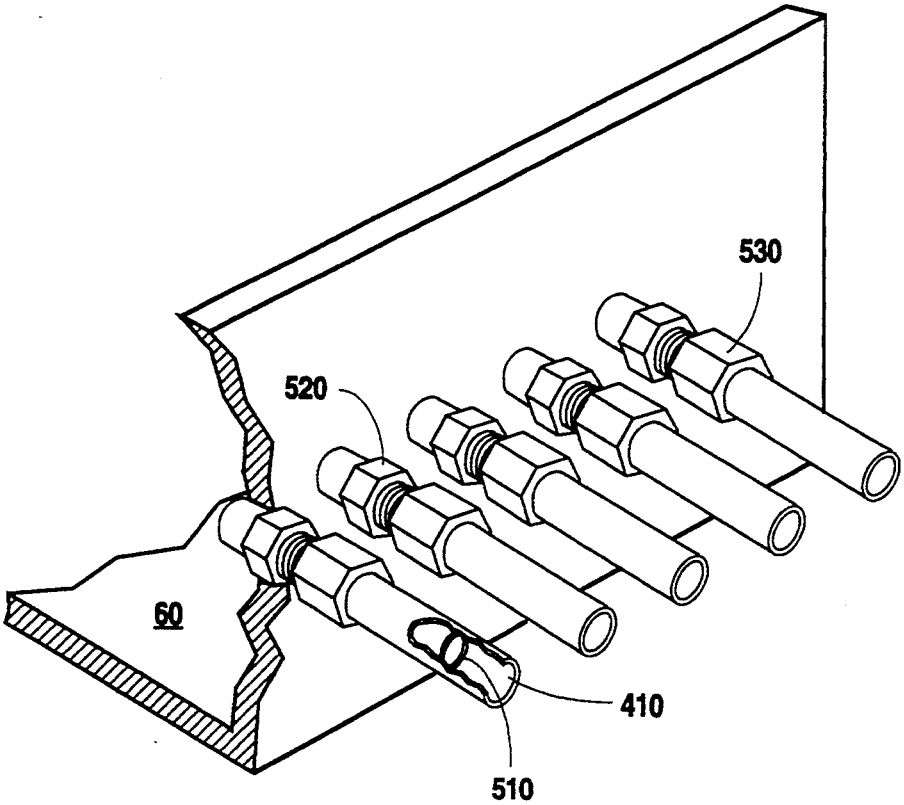
FIG. 5 is a partial perspective view in cross-section depicting the slurry reservoir of the article forming apparatus of the present invention.

As shown in FIG. 5, a plurality of connectors 520 (50 in the preferred embodiment) mount through the wall of slurry reservoir 60 facing tubes 410 using any suitable means such as welding or glue. Connectors 520 communicate with the inside of slurry reservoir 60 to furnish an exit for the slurry. Additionally, a plurality of truncated tubes 510 threadably attach to connectors 520 via threaded caps 530 in order to provide a rigid mounting surface for tubes 410. Thus, each of tubes 410 slidably mounts over a respective truncated tube 510 to provide fluid communication from slurry reservoir 60.

Figure 7:
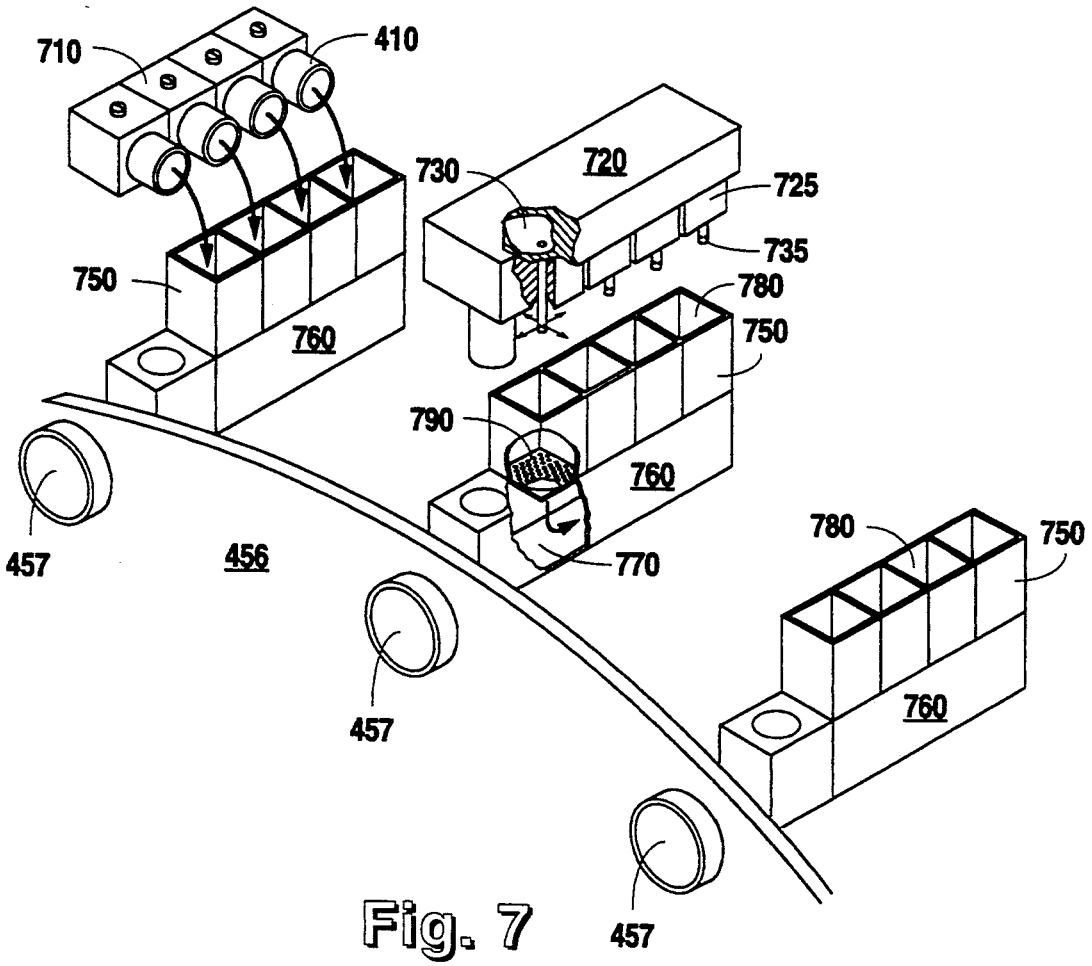
FIG. 7 is a partial perspective view in cross-section depicting the molds and plunger of the article forming apparatus of the present invention.

As shown in FIGS. 4 and 7, clamps 710 hold the ends of tubes 410 opposite from slurry reservoir 60 positioned over molds 750. Clamps 710 mount onto frame 75 using any suitable means such as screws or nuts and bolts. Tubes 410 lay flat along the center portion of frame 75 and mount onto frame 75 as described above such that each stroke of pump 65 forces slurry from tubes 410 into molds 750 of mold wheel 70.

Figure 6:
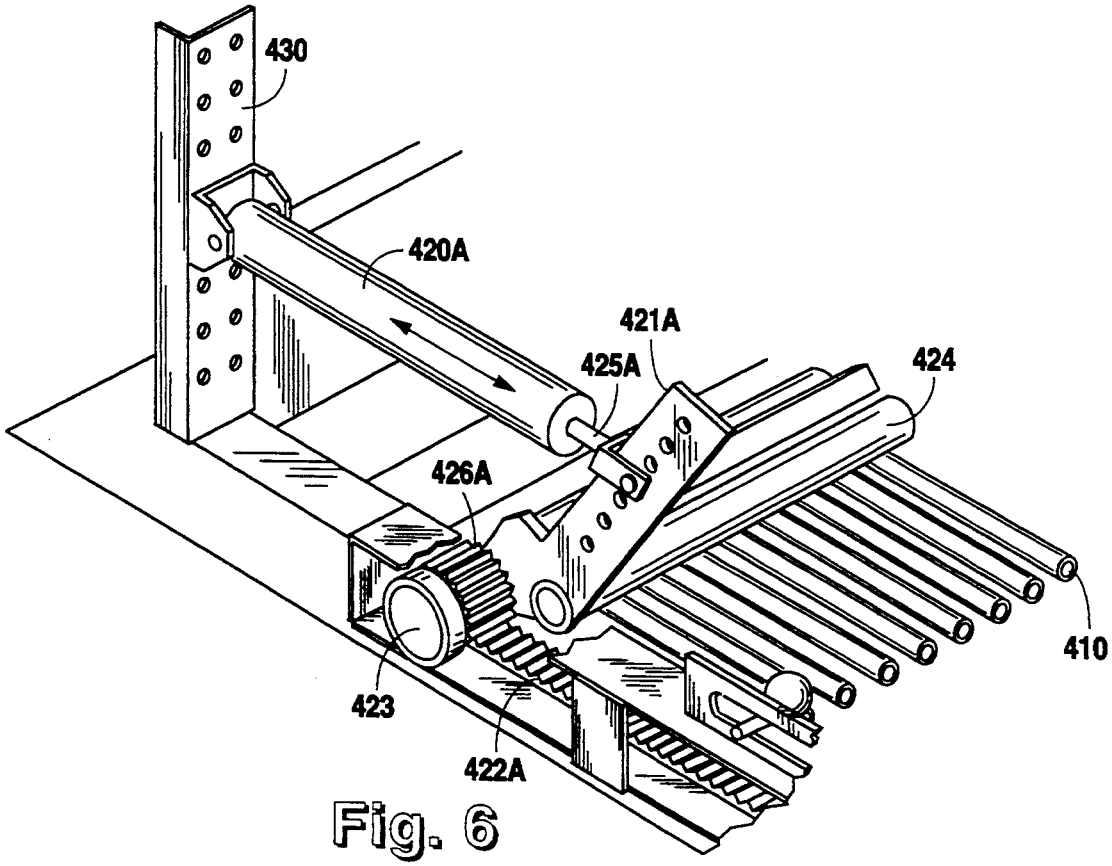
FIG. 6 is a partial perspective view depicting the slurry pump of the article forming apparatus of the present invention.

Referring specifically to FIGS. 4 and 6, pump 65 comprises cylinders 420A and B, brackets 421A and B, gear racks 422A and B, axle 423, tubes 410, tube roller 424, cylinder arms 425A and B, gear 426A, and a second gear (not shown) mounted on gear rack 422B. For disclosure purposes only cylinder 420A will described with reference to FIG. 6, however, cylinder 420B mounts onto frame 75 similarly to cylinder 420A and operates in unison with cylinder 420A to drive axle 423 and operate tube roller 424 to pump the slurry from slurry reservoir 60 into the molds of mold wheel 70.

Cylinder 420A mounts onto leg 430 of frame 75 using any suitable means such as nuts and bolts or welding. Additionally, cylinder arm 425A of cylinder 420 mounts onto bracket 421A using any suitable means such as a nut and bolt. Bracket 421A connects to axle 423 using any suitable means such as welding. Although bracket 421 rigidly connects to axle 423, its angular shape permits slight rotational motions about axle 423. In the preferred embodiment, bracket 421 comprises a dog leg or L-shaped bracket. Tube roller 424 loosely attaches to bracket 421A using a bearing. Gear 426A mounts near the end of the end of axle 423 using any suitable means such as keying and engages the teeth of gear rack 422A to facilitate motion of axle 423. Gear rack 422A mounts onto frame 75 using any suitable means such as welding.

Cylinder 420A comprises a pneumatically operated cylinder that drives cylinder arm 425A in forward and return strokes to impart reciprocating motion to axle 423 and tube roller 424 through their connections to bracket 421A. Specifically, both ends of cylinder 420A communicate with either a source of pressurized air (not shown) or the atmosphere through a set of hoses (not shown). In the preferred embodiment, the source of pressurized air comprises an air tank (not shown) that mounts onto frame 75 and communicates with a compressor (not shown). Pump solenoid valves control the flow of compressed air to the ends of cylinder 420A and the venting of compressed air from the ends of cylinder 420A in response to control signals generated by microcontroller 656 (described herein with reference to FIG. 14).

To produce the reciprocating motion of cylinder arm 425A, the pump solenoid valve controlling compressed air flow to the rear end of cylinder 420A (i.e. the end opposite from cylinder arm 425A) actuates to allow delivery of compressed air into the rear of cylinder 420A. Concurrently, the pump solenoid valve controlling compressed air flow to the front end of cylinder 420A (i.e. the end adjacent to cylinder arm 425A) actuates to permit venting to the atmosphere of any compressed air contained in the front of cylinder 420A. As a result, the compressed air entering the rear of cylinder 420A forces cylinder arm 425A to extend outward from cylinder 420A. Cylinder arm 425A extends outward from cylinder 420A until bracket 421A trips a pump sensor (described herein) positioned along the path travelled by bracket 421A. The pump sensor supplies a signal that causes microcontroller 656 to retract cylinder arm 425A. To retract cylinder arm 425A, the pump solenoid valve controlling compressed air flow to the front of cylinder 420A actuates to allow delivery of compressed air into the front of cylinder 420A. Simultaneously, the pump solenoid valve controlling compressed air flow to the rear of cylinder 420A actuates to permit venting to the atmosphere of the compressed air accumulated in the rear of cylinder 420A. Consequently, the compressed air entering the front of cylinder 420A forces cylinder arm 425A to retract within cylinder 420A.

During operation, the source of pressurized air alternately delivers compressed air to the front and rear of cylinder 420A to continuously extend and retract cylinder arm 425A, thereby producing a reciprocating motion. Cylinder arm 425A transfers its reciprocating motion to axle 423 and tube roller 424 through bracket 421A in order to effect pumping of slurry through tubes 410. Specifically, as cylinder arm 425A extends to push against bracket 421A, bracket 421A rotates slightly forward on axle 423 because of its angular shape. The rotation of bracket 421A on axle 423 results in tube roller 424 also rotating forward and compressing tubes 410. Once bracket 421A pivots its full distance forward, the continued extension of cylinder arm 425A drives it forward, thereby driving axle 423 along gear rack 422A and tube roller 424 across tubes 410. As axle 423 traverses gear rack 422A, the teeth of gear 426A mesh with the teeth of gear rack 422A to secure axle 423 to gear rack 422A and provide smooth motion of axle 423 along gear rack 422A.

Additionally, the compression of tubes 410 by tube roller 424 coupled with the subsequent forward motion of tube roller 424 facilitate the movement of slurry from slurry reservoir 60 through tubes 410 and into molds 750. That is, after tubes 410 have been primed, the action of tube roller 424 across tubes 410 not only squeezes the slurry residing within tubes 410 out the outlets of tubes 410 and into molds 750 (see FIG. 7) but also draws slurry from slurry reservoir 60 into tubes 410.

More particularly, with tube roller 424 raised so that it does not compress tubes 410, no slurry flow occurs because the ambient air exerts substantially equal pressure against the slurry at the outlets of tubes 410 and the slurry contained within slurry reservoir 60. Alternatively, with tube roller 424 lowered to compress tubes 410, slurry flow ensues because tube roller 424 divides the slurry residing within tubes 410 into two segments and seals off the outlets of tubes 410 from their inlets at slurry reservoir 60. That is, after compression of tubes 410, the forward movement of tube roller 424 across tubes 410 squeezes a portion of the slurry segment positioned between it and the outlets of tubes 410 into molds 750. However, tube roller 424 exerts no force against the segment of slurry positioned behind it and, merely, separates that slurry segment from the outlets of tubes 410. Consequently, the pressure exerted by the ambient air against the slurry within slurry reservoir 60 forces slurry into tubes 410 as tube roller 424 moves forward because the continuous compression of tubes 410 removes the balancing pressure exerted by the ambient air at the outlets of tubes 410. Accordingly, during each forward stroke of cylinder arm 425A, tube roller drives slurry into molds 750 and induces replenishment of the supply of slurry to tubes 410.

Alternatively, during each return stroke of cylinder arm 425A, it lifts tube roller 424 off tubes 410 to prevent tube roller 424 from squeezing the slurry within tubes 410 back into slurry reservoir 60. Specifically, as cylinder arm 425A retracts to pull against bracket 421A, bracket 421A rotates slightly backward on axle 423 because of its angular shape. The rotation of bracket 421A on axle 423 results in tube roller 424 also rotating backward and lifting off tubes 410. Once bracket 421A pivots its full distance backward, the continued retraction of cylinder arm 425A pulls it backward, thereby driving axle 423 back along gear rack 422A and returning tube roller 424 back to its initial position over tubes 410. Once cylinder arm 425A returns to its initial position, microcontroller 656 initiates another forward stroke to deliver slurry to molds 750.

The length of the forward stroke of cylinder arm 425A controls the amount of slurry delivered to molds 750. The position of the pump sensor (described herein) along the path traversed by bracket 421A typically controls the length of the forward stroke of cylinder arm 425A. That is, the pump sensor may be positioned at any point along the extension path of cylinder arm 425A. Illustratively, if the pump sensor is located near the retracted position of cylinder arm 425A, it will be triggered quickly after a slight extension of cylinder arm 425A, thereby permitting only a small amount of slurry be delivered to each mold. Alternatively, either the placement of cylinder 420A on leg 430 of frame 75 may be varied or the connection point of cylinder arm 425A on bracket 421A may be altered to vary the length of the forward stroke of cylinder arm 425A.

Referring again to FIGS. 1,4 and 7 and to FIGS. 8–13 and 23, the apparatus for forming the article will be described. As shown in FIGS. 4 and 7, mold wheel 70 comprises a plurality of mold rows 450 (9 in the preferred embodiment). Each mold row 450 comprises a plurality of molds 750 (50 in the preferred embodiment) mounted onto the top of base 760. A plurality of openings (not shown) through the top of base 760 allow fluid communication between molds 750 and conduit 770 of base 760. Each one of molds 750 mounts over one of the openings through the top of base 760 and secures to base 760 using any suitable means such as welding. In the preferred embodiment, molds 750 comprise hollow cubes having openings 780 and corresponding openings at their opposite ends which facilitate fluid communication between molds 750 and conduit 770. However, screens 790 reside on the top of base 760 to cover the openings through base 760 so that slurry contained in molds 750 will not seep into conduit 770.

After molds 750 have been mounted onto their respective bases 760 to form mold rows 450, each mold row 450 mounts at one end to plate 455 (see FIG. 4) and at their opposite end to plate 456 (see FIG. 7) using any suitable means such as welding. Furthermore, mold rows 450 fit onto plates 455 and 456 over openings 457 (see FIG. 7) which furnish apertures through plates 455 and 456 to allow fluid communication to and from conduits 770. Plates 455 and 456 comprise circular disks utilized to produce the ferris wheel configuration of mold wheel 70. Once mold rows 450 have been connected to plates 455 and 456, plates 455 and 456 rotatably attach to frame 75 using any suitable means such as an axle positioned on each of plates 455 and 456 and coupled to a pair of bearings mounted onto frame 75. Additionally, plate 456 connects to mold wheel drive 460 so that mold wheel 70 may be rotatably driven.

Figure 8:
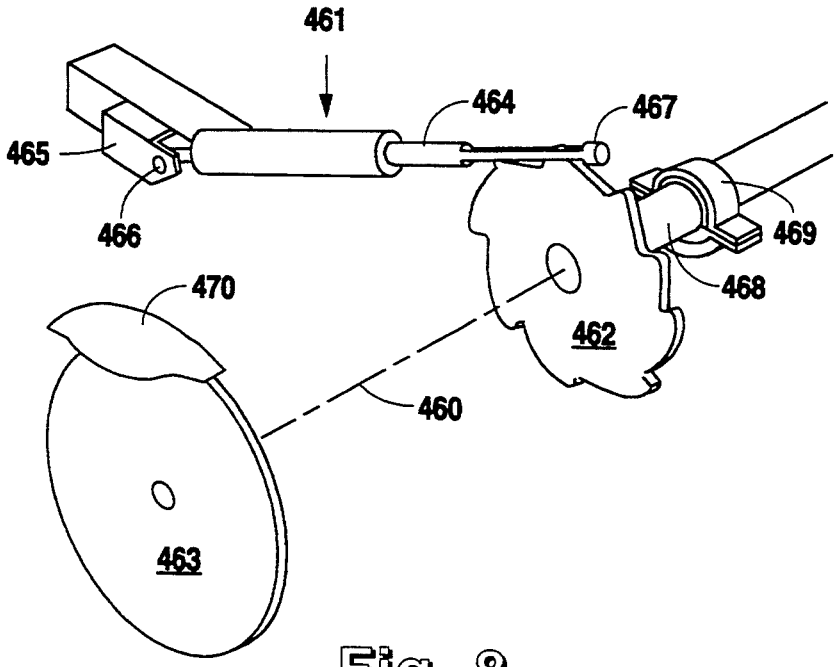
FIG. 8 is an exploded partial perspective view depicting the mold wheel drive of the article forming apparatus of the present invention.

Referring specifically to FIGS. 4 and 8, mold wheel drive 460 comprises cylinder 461, cylinder arm 464, gear 462, and brake plate 463. Cylinder 461 comprises a pneumatically operated cylinder that performs identically to cylinders 420A and B of pump 65 to extend and retract cylinder arm 464. The rear of cylinder 461 (i.e. the end opposite from cylinder arm 464) fluidly communicates with the source of pressurized air and pivotally mounts onto frame 75 using bracket 465 and pivot pin 466. Furthermore, the front of cylinder 461 (i.e. the end adjacent to cylinder arm 464) fluidly communicates with the source of pressurized air. A pair of mold wheel solenoid valves control the flow of compressed air from the source of pressurized air to the front and rear of cylinder 421 in response to control signals received from microprocessor 656 (described herein with reference to FIG. 14). Axle 468 connects at one end to gear 462 and at its opposite end to plate 456 of mold wheel 70 using any suitable means such as welding. Bearing 469 mounts onto frame 75 using any suitable means such as screws or nuts and bolts to support axle 468 and, thus, gear 462 on frame 75.

Cylinder arm 464 resides upon gear 462 to systematically engage the teeth of gear 462 via slot 467, thereby facilitating step-wise rotation of gear 462. With cylinder arm 464 retracted, one tooth of gear 462 resides within slot 467. Thus, as cylinder arm 464 extends in response to control signals received from microcontroller 656 (described herein), it pushes against the tooth residing within slot 467 to impart rotational motion to gear 462 and, consequently, to mold wheel 70. Cylinder arm 464 extends to rotate gear 464 until it advances sufficiently to trip a mold wheel drive sensor (described herein). In response to the signal produced by the mold wheel drive sensor, microcontroller 656 stops the forward motion of cylinder arm 464 and retracts it. On the return stroke of cylinder arm 464, cylinder 461 pivots about its pivotal connection to frame 75 to permit cylinder arm 464 to pass over the next tooth of gear 462 (i.e. the tooth directly behind cylinder arm 464). Additionally, after cylinder arm 464 fully retracts, cylinder 461 pivots to its initial position so that cylinder arm 464 engages the next tooth. That is, the next tooth resides within slot 467. On the next extension of cylinder arm 464, gear 462 again advances to index mold wheel 70 another short rotation. Accordingly, each forward stroke of cylinder arm 464 rotates mold wheel 70 circularly in a step-wise fashion to sequentially and continuously drive each of mold rows 450 through the different steps in the article forming process.

Brake plate 463 mounts onto axle 468 and caliper 470 mounts onto frame 75 using any suitable means such as welding. Caliper 470 includes a brake pad (not shown) forced against brake plate 463 by a spring (not shown) to provide braking forces against gear 462. That is, the spring continually forces the brake pad against brake plate 463 to transfer frictional forces to brake plate 463 which retard the motion of gear 462. The frictional forces are insufficient to prevent cylinder arm 464 from extending to advance gear 462. However, once cylinder arm 464 ceases to impart rotational forces against gear 462, the brake pad furnishes sufficient frictional forces against brake plate 463 to stop the rotation of gear 462 and eliminate any over rotation of gear 462 which would throw off the alignment of mold wheel 70.

As shown in FIG. 7, the first step in the article forming process comprises the delivery of slurry into molds 750 of the mold row 450 positioned below tubes 410 using pump 65 as previously described in reference to FIG. 6. Once pump 65 delivers slurry into molds 750, cylinder 461 extends cylinder arm 464 to drive gear 462 and index mold wheel 70 one position. As a result, the mold row 450 which just received the slurry rotates below plunger 480 so that the second step in the article forming process may be executed.

Plunger 480 shapes the slurry within molds 750 and forms a void within each article. Plunger 480 comprises housing 915 (see FIG. 9) which houses manifold 720. Manifold 720 mounts to housing 915 using any suitable means such as welding. Manifold 720 includes a plurality of mold blocks 725 (50 in the preferred embodiment) which are formed integrally with it. Conduit 730 within manifold 720 communicates with the source of pressurized air to provide compressed air to molds 750 through needles 735. Needles 735 mount within mold blocks 725 and extend through mold blocks 725 into conduit 730 to supply compressed air from conduit 730 into the slurry contained within each mold 750.

To begin the second step in the article forming process, plunger drive 905 (see FIG. 4) drives inner plunger housing 916 (see FIG. 9) and, thus, manifold 720 onto molds 750 until mold blocks 725 reside a short distance within molds 750, thereby sealing openings 780. Accordingly, the areas of the mold block faces from which needles 735 protrude are only slightly less than the areas of openings 780. That is, mold blocks 725 fit within molds 750 with a high degree of tolerance. Additionally, a gasket about each of mold blocks 725 provides an air tight seal between molds 750 and mold blocks 725.

Figure 9:
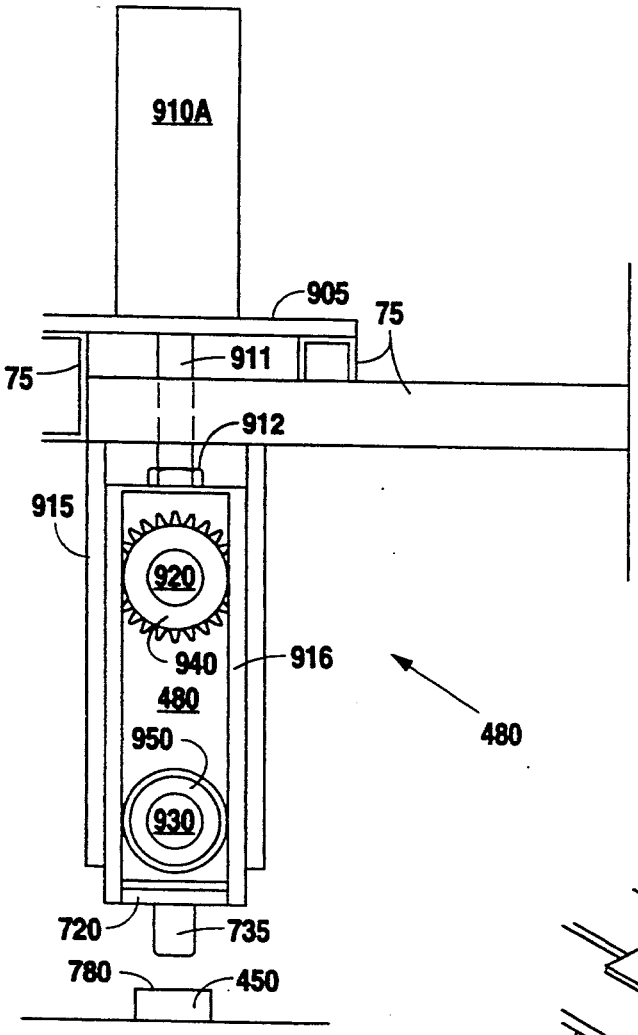
FIG. 9 is a side view depicting the plunger of the article forming apparatus of the present invention.
Figure 23:
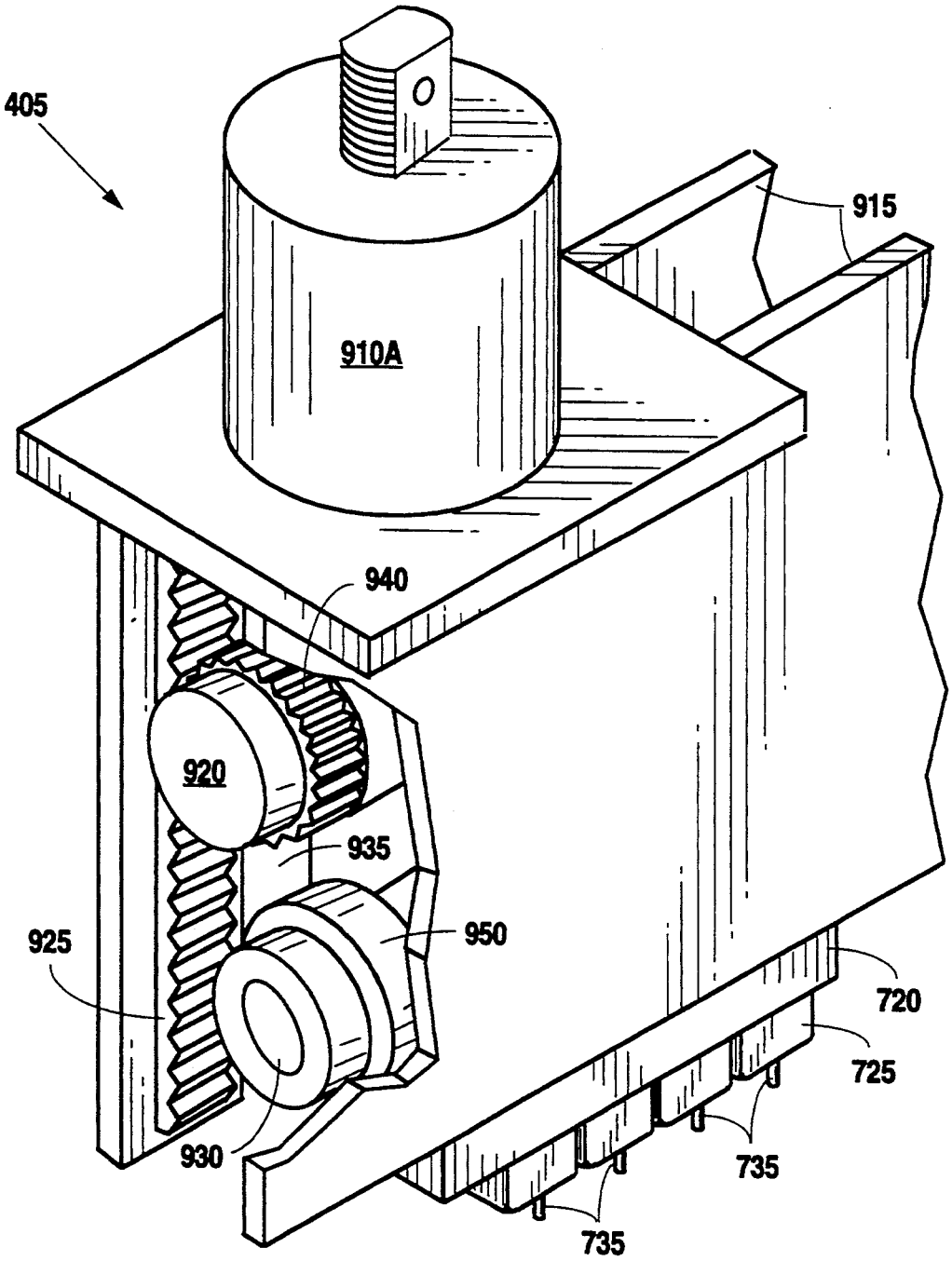
FIG. 23 is a partial perspective view depicting the plunger of the article forming apparatus of the present invention.

For disclosure purposes only the side of plunger drive 905 that includes cylinder 910A will be described. However, the side of plunger drive 905 that includes cylinder 910B mounts onto frame 75 and outer plunger housing 915 identically and operates in unison with the side of plunger drive 905 including cylinder 910A to drive manifold 720 onto molds 750. As shown in FIGS. 9 and 23, outer plunger housing 915 mounts to frame 75 using any suitable means such as welding. Cylinder 910A comprises a pneumatically operated cylinder that performs identically to cylinders 420A and B of pump 65 to extend and retract cylinder arm 911 (see FIG. 9). Cylinder 910A mounts onto outer plunger housing 915 using any suitable means such as welding. Both the rear of cylinder 910A (i.e. the end opposite from cylinder arm 911) and the front of cylinder 910A (i.e. the end adjacent to cylinder arm 911) fluidly communicate with the source of pressurized air. A pair of plunger drive solenoid valves control the flow of compressed air from the source of pressurized air to the front and rear of cylinder 910A in response to control signals received from microprocessor 656 (described herein with reference to FIG. 14).

Cylinder arm 911 mounts onto inner plunger housing 916 using nut 912 (see FIG. 9). Specifically, nut 912 welds onto inner plunger housing 916, and then cylinder arm 911 threadably screws within nut 912 to attach cylinder 910A to inner plunger housing 916. Axle 920 and alignment bearing axle 930 mount to inner plunger housing 916 using any suitable means such as welding. Gear rack 925 and alignment track 935 mount to outer plunger housing 915 using any suitable means such as welding. Gear 940 mounts onto the end of axle 920 using any suitable means such as keying and traverses gear rack 930 in response to the extension and retraction of cylinder arm 911 to produce smooth motion of axle 920 along gear rack 930. Additionally, alignment bearing 950 mounts onto the end of alignment bearing axle 930 using any suitable means such as keying and traverses alignment track 935 in response to the extension and retraction of cylinder arm 911 to stabilize the motion of manifold 720 as it travels to and from the mold row 450 positioned beneath it.

Specifically, in response to a plunger advance control signal received from the microcontroller 656, the source of pressurized air delivers compressed air to the rear of cylinder 910A, while the front of cylinder 910A vents to the atmosphere. Consequently, cylinder arm 911 extends in a forward stroke to impart a driving force against inner plunger housing 916. As cylinder arm 911 extends from cylinder 910A, gear 940 and, thus, axle 920 travel down along gear rack 930. Gear 940 provides smooth and uniform motion of axle 920 along gear rack 930, while alignment bearing 950 stabilizes the motion of manifold 720 as it travels toward the mold row 450 positioned beneath it. Accordingly, as cylinder arm 911 drives inner plunger housing 916 and, thus, manifold 720 down, mold blocks 725 cover the openings 780 into molds 750 of the mold row 450 positioned beneath plunger 480. After cylinder arm 911 trips a plunger down sensor (described herein), microcontroller 656 stops the extension of cylinder arm 911. However, microcontroller 656 maintains air pressure to the rear of cylinder 910A so that plunger 480 may execute article formation.

At the end of the forward stroke of cylinder arm 911, mold blocks 725 reside within molds 750 such that needles 735 penetrate into the center of the blob of slurry residing within molds 750. Microcontroller further in response to the plunger down signal, produces an air flow control signal that couples conduit 730 of manifold 720 with the source of pressurized air through an air hose (not shown). Accordingly, the compressed air exits conduit 730 through needles 735 and enters the slurry blobs contained within molds 750. As a result, the slurry blobs expand to fill the molds 750 and assume their desired shape (i.e. the shape of the molds 750). The injection of the compressed air not only expands the slurry blobs throughout the molds 750 but also forms the void in the center of the produced articles. That is, as the slurry expands away from its center to fill the excess space in the molds 750, a void naturally forms within the slurry blob because pump 65 delivers an insufficient amount of slurry into the molds 750 to form a completely solid article. Additionally, after the slurry fully expands throughout the molds 750, the injection of the compressed air removes water from the slurry within the molds 750 through screens 790 and the openings into the conduits 770 of base 760. The connection of the conduit 770 of the mold row 450 positioned below plunger 480 to vacuum chamber 80 (described herein) effects the removal of the water. With the conduit 770 connected to vacuum chamber 80, the compressed air flows through the expanded slurry and into the conduit 770 where it travels to vacuum chamber 80. The compressed air flows easily through the expanded slurry to drive water from the slurry because of the large difference in pressures between the compressed air and vacuum chamber 80.

Once the compressed air expands the slurry and removes some water, microcontroller 656 uncouples the source of pressurized air from conduit 730 of manifold 730. At this point, microcontroller 656 also couples the front of cylinder 910A to the source of pressurized air and vents the rear of cylinder 910A to the atmosphere. As a result, cylinder arm 911 retracts to pull inner plunger housing 916 and, thus, manifold 720 from the mold row 450 so that mold wheel drive 460 may index the next mold row 450 to a position below plunger 480. With the pulling of manifold 720 from the molds 750, needles 735 disengage from the expanded slurry within the molds 750. Although the injection of compressed air removes sufficient water to permit the expanded slurry to retain their voids, sufficient water does remain to allow the expanded slurry to seal about the needle punctures.

Referring again to FIG. 7 and to FIGS. 10 and 11, the connection of vacuum chamber 80 (see FIG. 1) to the mold rows 450 to remove the remaining water from the expanded slurry contained within the molds 750 will be described. As previously delineated, the ends of mold rows 450 connect to plates 455 and 456 such that openings 457 in plates 455 and 456 allow conduits 770 of mold rows 750 to receive and expel compressed air. Vacuum chamber 80 comprises an enclosure from which air is evacuated using an air pump (not shown).

During the step of expanding the slurry within molds 750 and the four subsequent steps in the article forming process, the mold rows 450 fluidly communicate with vacuum chamber 80 via manifold 810. Manifold 810 and a similar one mounted on the opposite end to frame 75 couple conduits 770 of mold rows 450 to vacuum chamber 80. For disclosure purposes, only manifold 810 will be described because the manifold opposite to it engages mold rows 450 similarly and connects to frame 75 identically. However, the manifold opposite to manifold 810 does not couple the mold rows 450 to vacuum chamber 80, instead, it merely seals openings 457 of plate 456 so that conduits 770 will communicate with vacuum chamber 80 only through manifold 810.

Figure 10:
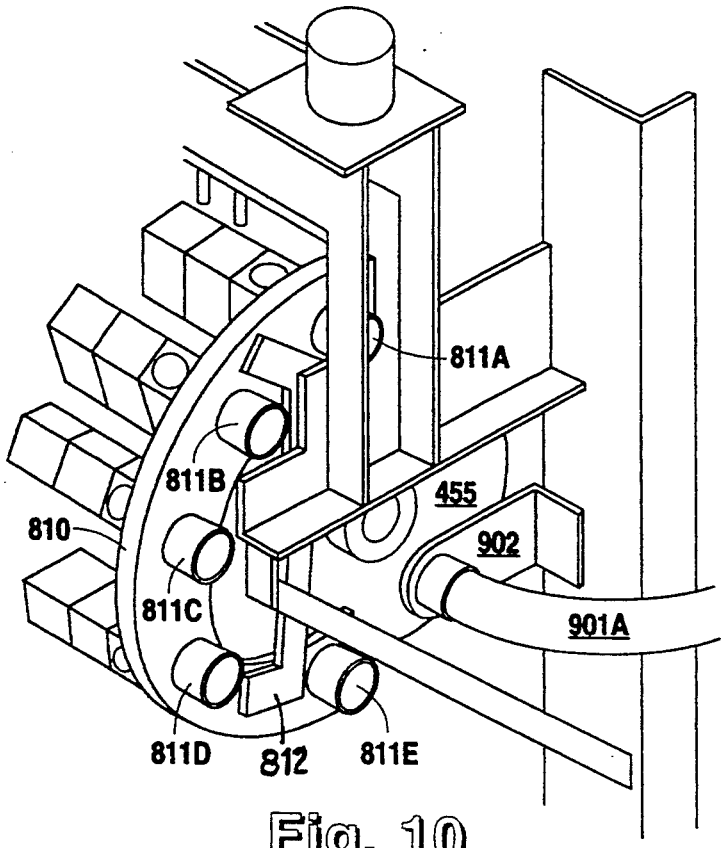
FIG. 10 is a partial perspective view depicting the vacuum chamber connections of the article forming apparatus of the present invention.
Figure 11:
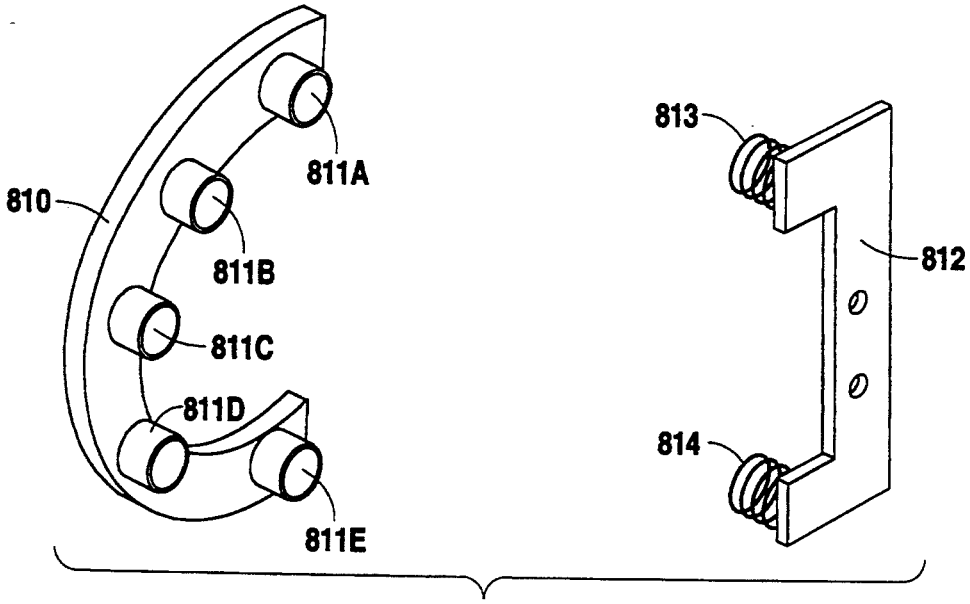
FIG. 11 is an exploded partial perspective view depicting the vacuum chamber connections of the article forming apparatus of the present invention.

Referring specifically to FIGS. 10 and 11, manifold 810 includes outlets 811A–E to connect openings 457 of mold wheel plate 455 to vacuum chamber 80. Vacuum hoses (not shown) mount over outlets 811A–E using any suitable means such as clamps to connect outlets 811A–E with vacuum chamber 80 and to communicate water into vacuum chamber 80. Manifold 810 mounts onto frame 75 such that it abuts plate 455. However, because mold wheel 70 rotates to index the mold rows 450 through the steps of the article forming process, manifold 810 cannot produce frictional forces sufficient to inhibit this rotation. Accordingly, bracket 812 and springs 813 and 814 spring load manifold 810 against plate 455. Springs 813 and 814 connect to bracket 812 and manifold 810 using any conventional means such as welding. Bracket 812 mount onto frame using any conventional means such as nuts and bolts or screws. With bracket 812 mounted on frame 75, springs 813 and 814 thrust manifold 810 against plate 455 with sufficient force to produce an air tight seal between openings 457 of plate 455 and outlets 811A–E. However, that force is insufficient to prevent rotation of mold wheel 70.

During operation as described above, the particular mold row 450 positioned below tubes 410 receives slurry into its molds 750 and then indexes into a position below plunger 480 via the stepwise rotation of gear 462. As the mold row 450 rotates underneath plunger 480, its conduit 770 simultaneously aligns with outlet 811A through opening 457 of plate 455 to connect to vacuum chamber 80. At this point, plunger drive 905 propels plunger 480 onto the mold row 760, and needles 735 communicate compressed air into the slurry within each of molds 750, resulting in the slurry being expanded as described above. With the conduit 770 of the mold row 450 connected to vacuum chamber 80, the compressed air flows through the expanded slurry and into conduit 770 where it travels to vacuum chamber 80 via outlet 811A and the vacuum hose (not shown) connecting outlet 811A to vacuum chamber 80. The compressed air flows easily through the expanded slurry because of the large difference in pressures between the compressed air and vacuum chamber 80. As previously described, the flow of compressed air from the source of compressed air drives a significant portion of the water forming the slurry into conduit 770 and, thus, vacuum chamber 80 where both the compressed air and water accumulate.

During each of the next four indexes of mold wheel 70 by mold wheel drive 460, outlets 811B-E couple the mold row 450 sequentially to vacuum chamber 80. Each subsequent connection of the mold row 450 reclaims water from the slurry expanded into the articles, thereby drying them into a state where they will retain their shape. Specifically, the difference between the ambient air pressure and the pressure within vacuum chamber 80 precipitates an air flow through the articles. That air flow forces water from the articles and carries the removed water to vacuum chamber 80. Consequently, with each subsequent connection of the mold row 450 to vacuum chamber 80, the air flow through the articles extracts increasing amounts of water, resulting in the articles hardening into their final shape.

Furthermore, the above-described water removal steps not only dry the slurry into the hardened articles but also reclaim the water for reuse. A water pump (not shown) transfers the water which accumulates within vacuum chamber 80 from vacuum chamber 80 into water supply tank 50. That is, when water accumulates to a predetermined level within vacuum chamber 80, the water pump activates to siphon the water from vacuum chamber 80 and deliver it to water supply tank 50. Accordingly, the water reclamation resulting from the draining of excess water from within slurry tank 40 and the removal of the water within vacuum chamber 80 permits approximately 95% of the water in the article forming process to be reused. Additionally, the air pump connected to vacuum chamber 80 pumps the compressed air that accumulates within vacuum chamber 80 during the water removal steps from vacuum chamber 80 to maintain a proper vacuum within vacuum chamber 80.

Figure 12:
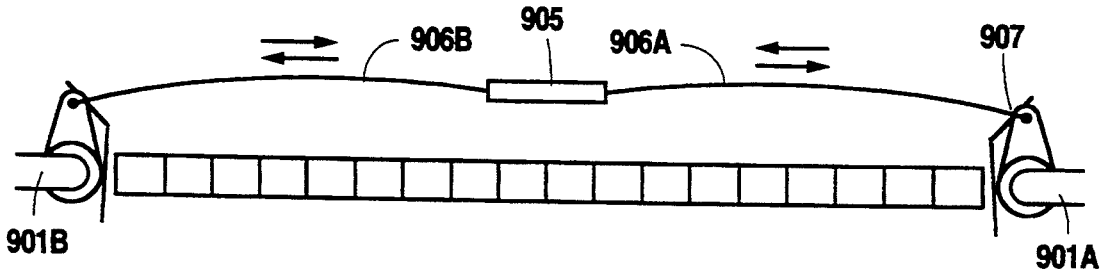
FIG. 12 is a front view in partial depicting the ejector of the article forming apparatus of the present invention.
Figure 13:
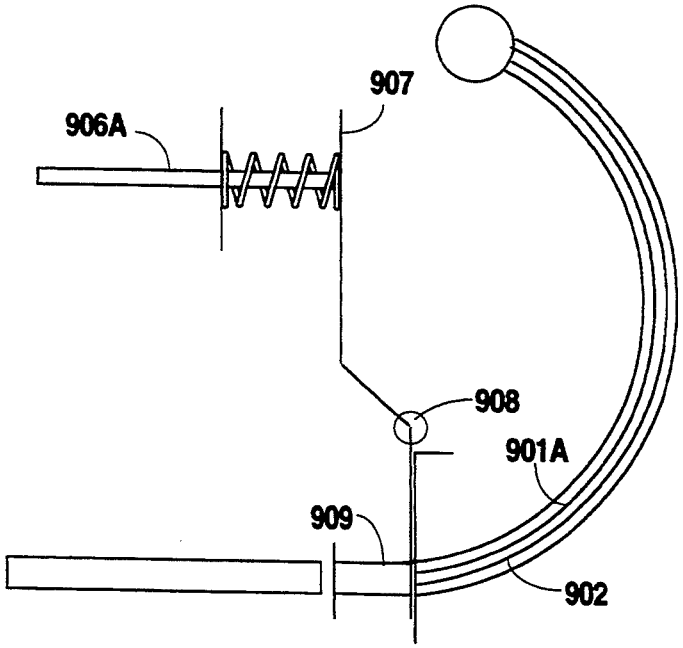
FIG. 13 is a top view in partial depicting the ejector of the article forming apparatus of the present invention.

Referring to FIGS. 12 and 13, the ejection of the formed articles from the mold rows 450 onto conveyor 90 will be described. To eject the articles, ejector 900 couples the source of pressurized air (not shown) to the conduit 770 of the mold row 450 rotated by mold wheel drive 460 to a position between air hoses 901A and B. Once the mold row 450 aligns with air hoses 901A and B, the source of pressurized air delivers compressed air into the conduit 770 and to the underside of molds 750 via the openings through base 760 which are covered by screens 790. The compressed air enters the molds 750 to propel the articles from the molds, thereby ejecting them. During the ejection step, mold wheel drive 460 rotates mold wheel 70 such that mold row 450 positions between air hoses 901A and B to orient in a substantially downward direction. As a result, the delivery of compressed air to the underside of molds 750 drives the articles from the molds 750 and onto conveyor 90 (see FIG. 1).

Ejector 900 includes cylinder 905 which comprises a two-way pneumatic cylinder having cylinder arms 906A and B (see FIG. 12). Cylinder 905 attaches to frame 75 using any suitable means such as brackets employing nuts and bolts or welding and operates similarly to cylinders 420A and B, except cylinder 905 simultaneously extends and retracts cylinder arms 906A and B. The center and both ends of cylinder 905 fluidly communicate with the source of pressurized air. A pair of ejector cylinder solenoid valves control the flow of compressed air from the source of pressurized air to the center and ends of cylinder 905 in response to control signals received from microprocessor 656 (described herein with reference to FIG. 14). Accordingly, to extend cylinder arms 906A and B the source of pressurized air delivers compressed air to the center of cylinder 905 while the ends of cylinder 905 vent to the atmosphere. Alternatively, to retract cylinder arms 906A and B, the source of pressurized air delivers compressed air to both ends of cylinder 905 while the center of cylinder 905 vents to the atmosphere.

Although only the side of ejector 900 that includes air hose 901A will be described, the side of ejector 900 that includes air hose 901B mounts to frame 75 identically, connects to cylinder arm 906B similarly, and operates in unison with the side of ejector 900 including air hose 901A to propel the articles from molds 750. Bracket 902 mounts air supply hose 901A to frame 75 (see FIG. 10) and secures to frame 75 using any suitable means such as welding. As shown in FIG. 13, cylinder arm 906A connects at the end opposite from cylinder 905 to pivot plate 907 using any suitable means such as welding. Pivot plate 907 mounts onto frame 75 at pivot point 908 using any suitable means such as welding. Furthermore, the end of pivot plate 907 opposite from the end connected to cylinder arm 906A mounts over air hose 901A to facilitate the extension and retraction of air hose 901A.

During operation, the extension of arm 906A from cylinder 905 results in air hose 901A being pushed to abut plate 455 of mold wheel 70 in a position over an opening 457 through plate 455. More particularly, the pressure against pivot plate 907 exerted by cylinder arm 906A causes the end of pivot plate 907 connected to cylinder arm 906A to pivot towards pivot point 908. Consequently, the end of pivot plate 907 connected to air hose 901A pivots away from pivot point 908 and pushes air hose 901A against 455. Air supply hose 901A pushes against and pulls from plate 455 because the its does not rigidly connect to bracket 902. Bracket 902, therefore, supports air supply hose 901A but does not prevent the reciprocating motion of air hose 901A. End cap 909 connects to the end of air hose 901A to ensure the proper sealing of air hose 901A against plate 455. After cylinder arm 906A pushes air hose 901A against an opening 457 through plate 455, an ejector air flow control solenoid valve actuates in response to a signal generated by microcontroller 656 (described herein) to allow compressed air flow from the source of pressurized air to the conduit 770 of the mold row positioned between ejector 900. The ejector air flow control solenoid valve also permits delivery of compressed air to air hose 901B. As a result, compressed air enters the underside of molds 750 to ejection the articles onto conveyor 90. After a time delay, microcontroller 656 deactuates the air flow control solenoid valve to remove the flow of compressed air to the conduit 770. Concurrently, cylinder arms 906A and B retract so that the next mold row 450 may be indexed by mold wheel drive 460 between ejector 900 for ejection of the articles contained within its molds 750.

Figure 14:
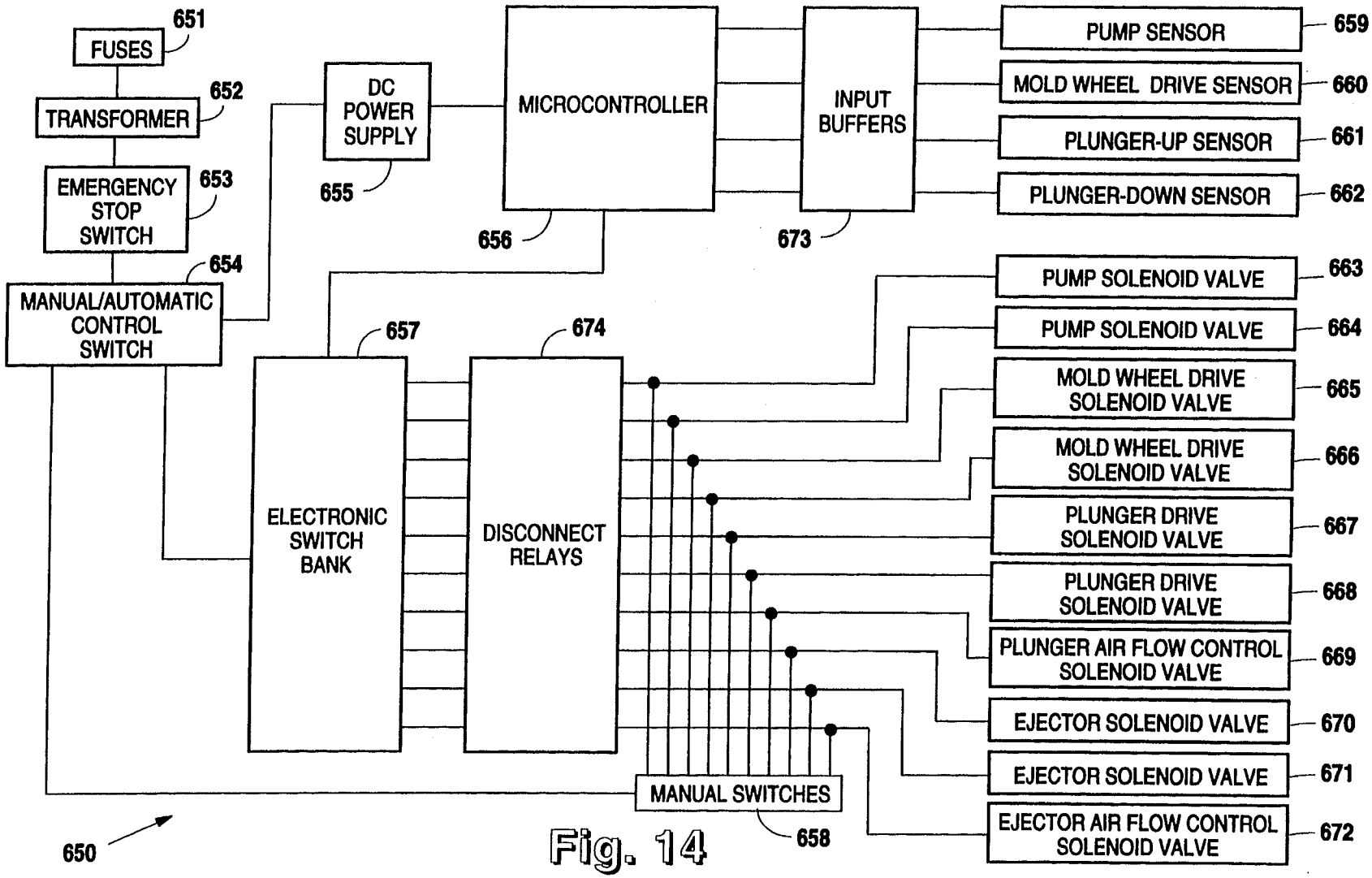
FIG. 14 is a schematic diagram depicting the microcontroller unit of the article forming apparatus of the present invention.

Referring to FIG. 14, control of the article forming process by microcontroller circuit 650 will be described. Microcontroller circuit 650 receives power at an input from a typical 220 volt AC supply line. Fuses 651 receive the 220 volt input to prevent excessive power from being delivered to transformer 652. Transformer 652 transforms the 220 volt input voltage to standard 110 voltage. Emergency stop switch comprises a push button switch that allows power to microcontroller system 650 to be interrupted in the event of an emergency. Manual/automatic control switch 654 permits power interruption to microcontroller 656 so that manual switches 658 may be used to manually control the article forming process. Manual/automatic control switch 654 also supplies the transformed AC input to electronic switch bank 657 which, in turn, delivers that AC voltage to solenoid valves 663–672 under the control of microcontroller 656. Additionally, disconnect relays 674 prevent the false triggering of the electronic switches when the article forming apparatus is operated in its manual mode. DC power supply 655 receives the standard 110 volt input from manual/automatic control switch 654 and rectifies that AC voltage to produce the DC voltage required to operate microcontroller 656. Microcontroller 656 generates the control signals that operate the article forming process in an automatic manufacturing procedure. Sensors 659–662 provide data to microcontroller 656 which it processes to generate control signals that operate electronic switch bank 657. Input buffers 673 buffer the data signals input into microcontroller 656 from sensors 659–662.

During normal operation, microcontroller 656 begins each cycle of the article forming process by generating, in response to a signal received from plunger up sensor 662 (described herein), mold wheel advance control signals that close the switches of electronic switch bank 657 which deliver power to mold wheel drive solenoid valves 665 and 666. Mold wheel drive solenoid valves 665 and 666 comprise two-way solenoid valves that control the delivery of compressed air from the source of pressurized air (not shown) to cylinder 461 of mold wheel drive 460 and the venting of compressed air from cylinder 461. Specifically, mold wheel drive solenoid valve 665 mounts within a hose connecting the rear of cylinders 461 (i.e. the end opposite from cylinder arm 464) to the source of pressurized air, while mold wheel drive solenoid valve 664 mounts within a hose connecting the front of cylinder 461 (i.e. the end adjacent to cylinder arm 464) to the source of pressurized air. Accordingly, when energized by the mold wheel advance control signals, mold wheel drive solenoid valve 665 actuates to couple the rear of cylinder 461 to the source of pressurized air, while mold wheel drive solenoid valve 666 actuates to vent the front of cylinder 461 to the atmosphere. Consequently, cylinder arm 464 of cylinders 461 extends in the forward stroke of mold wheel drive 460 which advances mold wheel 70 one position.

Mold wheel drive sensor 660 connects to frame 75 to furnish a signal to microcontroller 656 which informs microcontroller 656 that mold wheel drive 460 has completed the indexing of mold wheel 70 one position. Mold wheel sensor 660 comprises a mechanical arm limit switch that trips due to the extension of cylinder arm 464. In response to the tripping of mold wheel sensor 660, microcontroller 656 generates a mold wheel drive return signal that reverses the actuation of the two-way solenoids which comprise mold wheel drive solenoid valves 665 and 666. As a result, mold wheel drive solenoid valve 666 couples the front of cylinder 461 to the source of pressurized air, while mold wheel drive solenoid valve 665 vents the rear of cylinder 461 to the atmosphere. Consequently, the cylinder arm 464 retracts into cylinder 461 until it reaches its completely retracted position.

Microcontroller 656 further generates pump advance control signals in response to the tripping of mold wheel drive sensor 660. Specifically, microcontroller 656 activates the electronic switches in electronic switch bank 657 that deliver power to pump solenoid valves 663 and 664. Similar to mold wheel drive solenoid valves 665 and 666, pump solenoid valves 663 and 664 comprise two-way solenoid valves that control the delivery of compressed air from the source of pressurized air to cylinders 420A and B of pump 65 and venting of cylinders 420A and B to the atmosphere. Pump solenoid valve 663 mounts within a hose connecting the rears of pump cylinders 420A and B (i.e. the ends opposite from cylinder arms 425A and B) to the source of pressurized air, while pump solenoid valve 664 mounts within a hose connecting the fronts of cylinders 420A and B (i.e. the ends adjacent cylinder arms 425A and B) to the source of pressurized air. Thus, when energized by the pump advance control signals, pump solenoid valve 663 actuates to couple the rears of cylinders 420A and B to the source of pressurized air, while pump solenoid valve 664 actuates to vent the fronts of cylinders 420A and B to the atmosphere. Consequently, cylinder arms 425A and B extend in the forward stroke that forces slurry from tubes 410 into the molds 750 of the mold row 450 positioned below tubes 410.

Pump sensor 659 adjustably mounts onto frame 75 to furnish a signal to microcontroller 656 which informs microcontroller 656 that pump 656 has delivered the desired amount of slurry into the molds 750 of the mold row 450 positioned below tubes 410. Pump sensor 659 comprises a limit switch that trips due to the extension of cylinder arm 425A. In response to the tripping of pump sensor 659, microcontroller 656 generates pump return control signals that reverse the actuation of the two-way solenoids which comprise pump solenoid valves 663 and 664. Consequently, pump solenoid valve 664 couples the fronts of cylinders 420A and B to the source of pressurized air, while pump solenoid valve 663 vents the rears of cylinders 420A and B to the atmosphere. As a result, cylinder arms 425A and B retract into their respective cylinders 420A and B until they reach their completely retracted position.

Pump sensor 659 may be used to regulate the amount of slurry delivered to molds 750 because it may be positioned at any point along the extension path of cylinder arm 425A. Illustratively, if pump sensor 659 is located only a short distance from the retracted position of cylinder arm 425A, cylinder arm 425A will trip the mechanical arm of the limit switch which comprises pump sensor 659 extremely early in its forward stroke. As a result, only a small amount of slurry will be delivered into molds 750. Conversely, larger amounts of slurry may be delivered to molds 750 by positioning pump sensor 659 further from cylinder arm 425A. Thus, pump 65 delivers slurry in extremely small and precise quantities because the adjustability of pump sensor 659 allows precise control of the extension of cylinder arms 425A and B as well as minute variations in the point where they stop extending and begin retracting.

Microcontroller 656 still further generates plunger advance and ejector advance control signals in response to the tripping of mold wheel drive sensor 660. Similar to mold wheel drive solenoid valves 665 and 666 and pump solenoid valves 663 and 664, plunger drive solenoid valves 667 and 668 and ejector solenoid valves 670 and 671 comprise two-way solenoid valves that control the delivery of compressed air from the source of pressurized air to cylinders 910A and B and 905, respectively, and venting of cylinders 910A and B and 905, respectively, to the atmosphere.

Specifically, microcontroller 656 generates control signals that activate the switches of electronic switch bank 657 that supply plunger drive solenoid valves 667 and 668 and ejector drive solenoid valves 670 and 671 with power. As a result, plunger drive solenoid valve 667 actuates to couple the rears of cylinders 910A and B (i.e. the ends opposite from their respective cylinder arms) to the source of pressurized air, while plunger drive solenoid valve 668 actuates to vent the fronts of cylinders 910A and B (i.e. the ends adjacent to their respective cylinder arms) to the atmosphere. Accordingly, cylinder arms 911 and the cylinder arm of cylinder 910B extend to drive inner plunger housing 916 and, thus manifold 720 onto the mold row 450 positioned below as previously described. Concurrently, ejector solenoid valve 670 actuates to couple the source of pressurized air to the center of cylinder 905, while ejector solenoid valve 671 actuates to vent both ends of cylinder 905 to the atmosphere. Consequently, cylinder arms 906A and B extend from cylinder 905 until they drive air hoses 901A and B against plates 455 and 456 of mold wheel 70 to cover the conduit 770 of the mold row 450 positioned therebetween as previously described.

Plunger down sensor 662 comprises a limit switch similar to mold wheel drive sensor 660 that trips to inform microcontroller 656 when plunger 480 reaches its lowered position. After microcontroller 656 receives the plunger down signal, it generates control signals which activate the switches in electronic switch bank 657 that deliver power to plunger air flow control solenoid valve 669 and ejector air flow control solenoid valve 672. The actuation of plunger air flow control solenoid valve 669 couples the source of pressurized air to manifold 720 of plunger 480. The source of pressurized air, thus, delivers air into manifold 720 where it exits from needles 735 into the slurry contained within the molds 750 of the mold row 450 located below plunger 480. Concurrently, ejector air flow control solenoid valve 672 actuates to couple air hoses 901A and B to the source of pressurized air. Consequently, the source of pressurized air delivers compressed air to the conduit 770 of the mold row 450 positioned between air hoses 901A and B. Accordingly, the compressed air entering the conduit 770 propels the articles contained within the molds 750 onto conveyor 90.

A timer internal microcontroller 656 determines the length of time microcontroller 656 maintains the control signals which actuate plunger air flow control solenoid valve 669 and ejector air flow control solenoid valve 672. That is, when microcontroller 656 receives the plunger down signal from plunger down sensor 662, it activates the internal timer, which then begins to run. Microcontroller 656 maintains the plunger and ejector air flow control signals while the timer runs. However, once the timer times out, microcontroller 656 removes the plunger and ejector control signals, thereby deactuating plunger air flow control solenoid valve 669 and ejector air flow control solenoid valve 672 and uncoupling the source of pressurized air from plunger 480 and air hoses 901A and B.

Additionally, once the internal timer times out, microcontroller 656 generates plunger and ejector return control signals that reverse the actuations of plunger drive solenoid valves 667 and 668 and ejector solenoid valves 670 and 671. Consequently, plunger drive solenoid drive valve 668 actuates to couple the fronts cylinders 910A and B to the source of pressurized air, while plunger drive solenoid valve 667 actuates to vent the rears of cylinders 910A and B. With plunger drive solenoid valves 667 and 668 reversed, cylinder arm 911 and the cylinder arm of cylinder 910B retract to lift inner plunger housing 916 and, thus, manifold 720 to their raised positions. Simultaneously, ejector solenoid valve 671 reverse actuates to connect the ends of cylinder 905 to the source of pressurized air, while ejector solenoid valve 670 reverse actuates to vent the center of cylinder 905 to the atmosphere. As a result, compressed air enters the ends of cylinder 905 to drive cylinder arms 906A and 906B towards the center of cylinder 905 until they reach their fully retracted position, thus, removing air hoses 901A and B from the mold row 450 located therebetween.

Plunger up sensor 661 comprises a limit switch similar to mold wheel drive sensor 660 that trips to inform microcontroller 656 when plunger 480 reaches its raised position. When microcontroller 656 receives the plunger up signal from plunger up sensor 661, it generates the mold wheel advance control signals which activate the switches of electronic switch bank 657 that supply power to mold wheel drive solenoid valves 665 and 666. At this point the above procedure repeats to pump slurry into the molds 750 of another mold row 450, inject air into the slurry within the molds 750 of the mold row 450 to shape the slurry into the article, connect four mold rows 450 to vacuum chamber 80 to dry the articles, and ejecting the cubes from the mold row 450 positioned between air hoses 901A and B.

Manual switches 658 allow solenoid valve 663–672 to be manually actuated so that testing and cleaning of the article forming apparatus may be performed. That is, the article forming process may be controlled manually through the manual activation of manual switches 658 to connect any one of solenoid valves 663–672 to the standard 110 volt input received from transformer 652.

For disclosure purposes, each step in the above-described article forming process (i.e. pumping the slurry into the mold rows 450, injecting compressed air into the slurry within the molds 750 of the mold row 450 positioned below plunger 480, connecting four mold rows 450 to vacuum source 80, and ejecting the cubes from the mold row 450 positioned between air hoses 901A and B) was described sequentially, however, all of the above steps are performed concurrently.

Referring again to FIG. 1, conveyor 90 conveys the ejected articles to elevator 91. Elevator 91 receives the articles and elevates them onto vibration table 92, which organizes the articles into a single layer. Once the vibration table 92 has organized the articles into a single layer, it transfers them to vibration table 93. Vibration table 93 arranges the articles into ordered rows having a specific width. At this point, vibration table 93 transfers a set of the ordered rows to tray 94, thereby placing a sheet of the articles onto tray 94. Tray 94 receives the sheet of articles and places that sheet onto envirobaler 95. Illustratively, after vibration table 93 transfers the article sheet onto tray 94, tray 94 extends over envirobaler 95 and places that sheet onto envirobaler 95. Tray 94 then retracts to receive another sheet of articles from vibration table 93, while envirobaler 95 lower a distance equal to the height of one of the articles in order to allow the next sheet of articles to be stacked on top of the previous sheet of articles during the next extension of tray 94. After tray 94 stacks the desired amount of article sheets onto envirobaler 95, the stacked sheets are wrapped and stored on pallet 96 for shipping.

Referring to FIGS. 15–21, the articles which relate to a free-flowing, lightweight, shock absorbing and stackable dunnage material will be described. In the preferred embodiment of the present invention, a biodegradable material such as newspaper or recycled paper products forms the dunnage material. As in shown in FIG.15, this dunnage material may be used to pack objects in containers for storage and/or shipment. The interior 221 of a box or container 220 receives object 222 for packaging before shipment. Dunnage material 223 made in accordance with the above-described article forming process of the present invention packs object 222 within container 220. Small individual pieces, i.e. articles of manufacture 224 that poured easily from scoop 225 into container 220 to provide a resilient cushion around object 222 form dunnage material 223. Dunnage material 223 may be poured into container 220 manually as shown in FIG. 1 or automatically blown or shoveled into container 220 using any suitable means. Articles 224 according to all exemplary embodiments of the present invention are formed as lightweight, geometrically shaped bodies that are readily pourable. During the pouring process articles 224 of dunnage material 223 are haphazardly oriented in relationship to each other. That haphazard orientation results in the forming of the resilient cushion around object 222.

Because paper products form articles 224, they do not experience the static cling problem which often interferes with the pourability of dunnage material formed from typical plastic/polystyrene pellets. Additionally, the outer surfaces of articles 224 provide a resistance to sliding forces which frictionally locks them together. Consequently, articles 224 form a relatively stable resilient cushion around object 222 10 which prohibits object 222 from migrating within dunnage material 223 toward walls 226 of container 220. Dunnage material 223, therefore, prevents object 222 from encountering the hazards associated with contacting walls 226 of box 220 during either shipment or storage.

Figure 16:
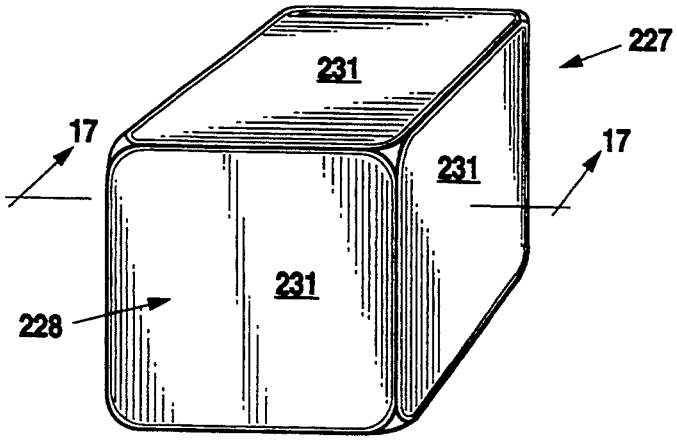
FIG. 16 is a perspective view depicting a first exemplary geometric shape for the articles of the present invention.
Figure 17:
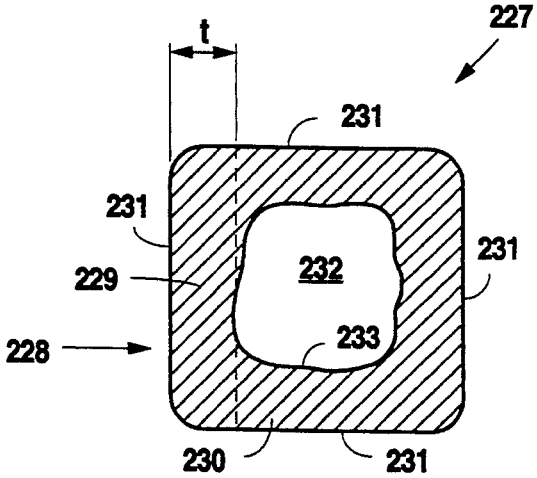
FIG. 17 is a cross-sectional view taken about the lines 3—3 of FIG. 16.
Figure 19:
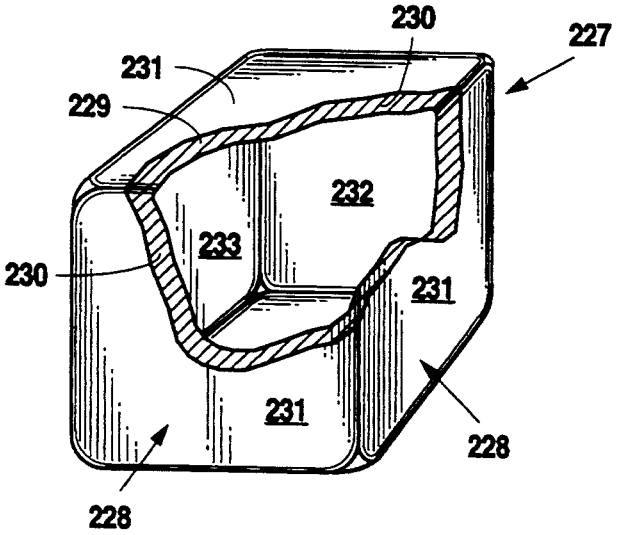
FIG. 19 is a perspective view in partial cross-section depicting the first exemplary geometric shape for the articles of the present invention.

As shown in FIGS. 16, 17 and 19, cubical structure 227 forms the individual, resilient, shock absorbing article of manufacture 224. A plurality of cubical structures 227 adapt for use as dunnage material 223 to pack and cushion object 222 within container 220. Cubical structure 227 comprises three-dimensional body 228 formed of closed shell 229. Biodegradable material preferably forms closed shell 229, however, certain synthetic materials may also form article of manufacture 224. In the preferred embodiment, a hydrophilic material, such as paper, and preferably recycled paper provides the biodegradable material. Outer surrounding sidewalls 230, configured to have contiguous faces 231 in the shape of a selected polygon, forms closed shell 229. Outer surrounding sidewalls 231 molds to be somewhat resilient such that under small amounts of pressure it will bend and return to its original shape when the pressure is removed.

As shown FIGS. 17 and 19, outer surrounding sidewalls 230 substantially surrounds internal void 232 to construct closed shell 229. Interior surface 233 supplies the boundaries of internal void 232. Internal void 232 preferably takes up approximately 30% to 90% of cubical structure 227. The size of the internal void 232 may be varied depending on what characteristics are desired for dunnage material 223. If the object to be packaged is not particularly delicate internal void 232 may be smaller, illustratively, approximately 30% to 50% of the total volume of cubical structure 227. That makes a sturdier, slightly heavier article 224 than an article having a larger internal void 232. Alternatively, the average thickness "t" of the wall of closed shell 229 may be formed with lesser thicknesses resulting in larger internal voids 232. A thinner closed shell 229 and larger internal void 232 result in a lighter weight, more resilient article 224 which is especially useful for packaging delicate objects.

FIG. 19 shows cubical structure 227 with approximately 75% of the total volume of the article 16 being internal cavity 232. Accordingly, cubical structure 232 may be employed to package delicate objects such as china and crystal. Interior void 232 is sized such that square faces 231 are of a sufficient thickness to provide resilience without being crushable. When used to package an object a plurality of cubical structures 227 create a resilient cushion that exhibits good shock absorbing properties. The basic principle underlying the shock absorbing properties is that the combination of the air space provided by internal void 232 each cubicle structure 227 along with the air space between the plurality of cubical structures disrupt the transmittal of jarring forces to object 222. Each individual article 224 of the present invention employs the basic principle described above.

Figure 18:
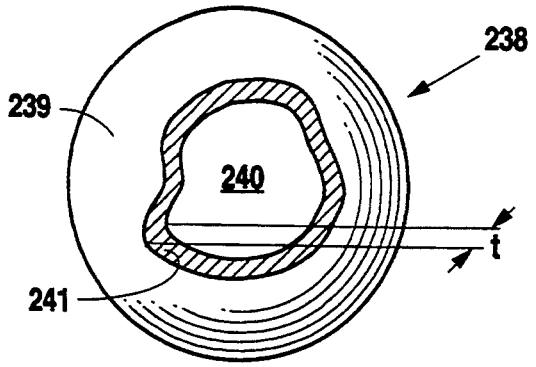
FIG. 18 is a perspective view in partial cross-section depicting a second exemplary geometric shape for the articles of the present invention.
Figure 20:
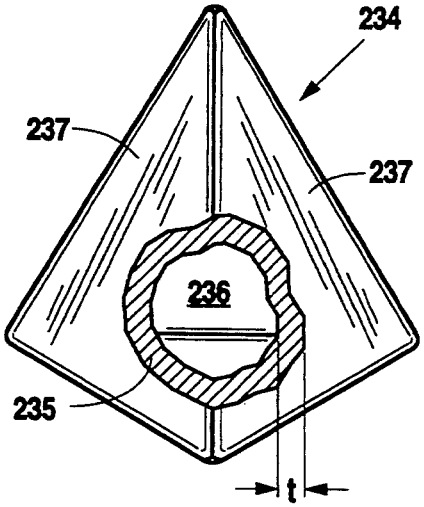
FIG. 20 is a perspective view in partial cross-section depicting a third exemplary geometric shape for the articles of the present invention.

FIGS. 18 and 20 show alternate structures that may form the individual, resilient, shock absorbing article of manufacture 224. Structures different in geometric shape and having different average thicknesses "t" of the walls which form the internal void implement article 224. Specifically, FIG. 20 shows triangular polyhedron 234 forming article 224. A closed shell 235, thinner than closed shell 229 shown in FIG. 19, forms the three-dimensional body of triangular polyhedron 234. Similar to internal void 232, internal void 236 is sized such that sidewalls 237 are of sufficient thickness to prevent triangular polyhedron 234 from crushing under the weight of object 222. Internal void 236 is typically formed to be between 30%–90% of the total volume of triangular polyhedron 234. As shown in FIG. 18, sphere 238 forms article of manufacture 224. Sphere 238 includes sidewall 239, again of thickness "t", which forms closed shell 241 that surrounds internal void 240.

Figure 15:
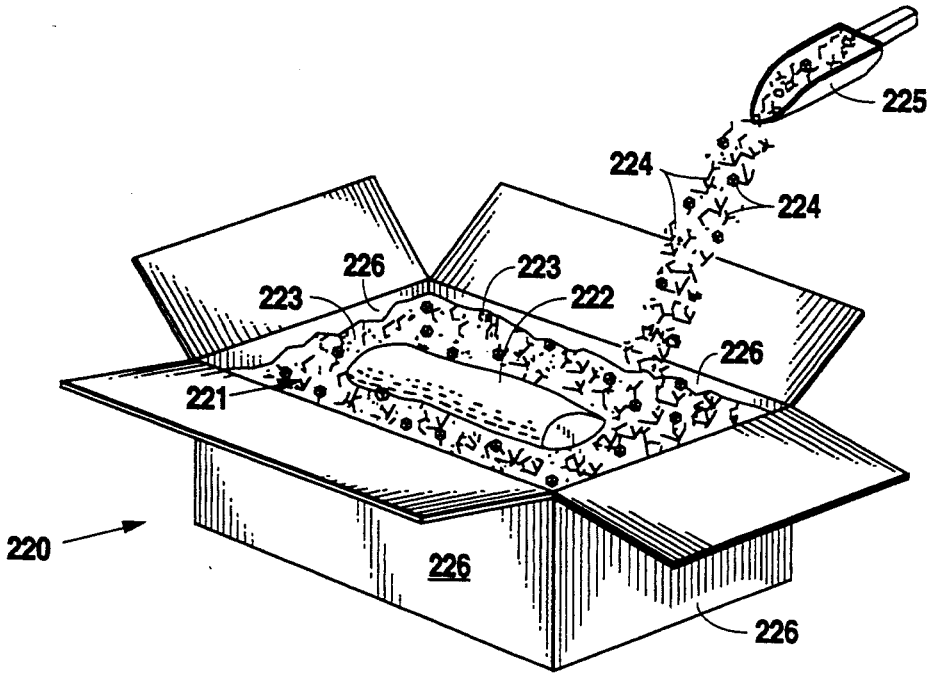
FIG. 15 is a perspective view depicting the articles of the present invention packed about an object placed within a container.
Figure 21:
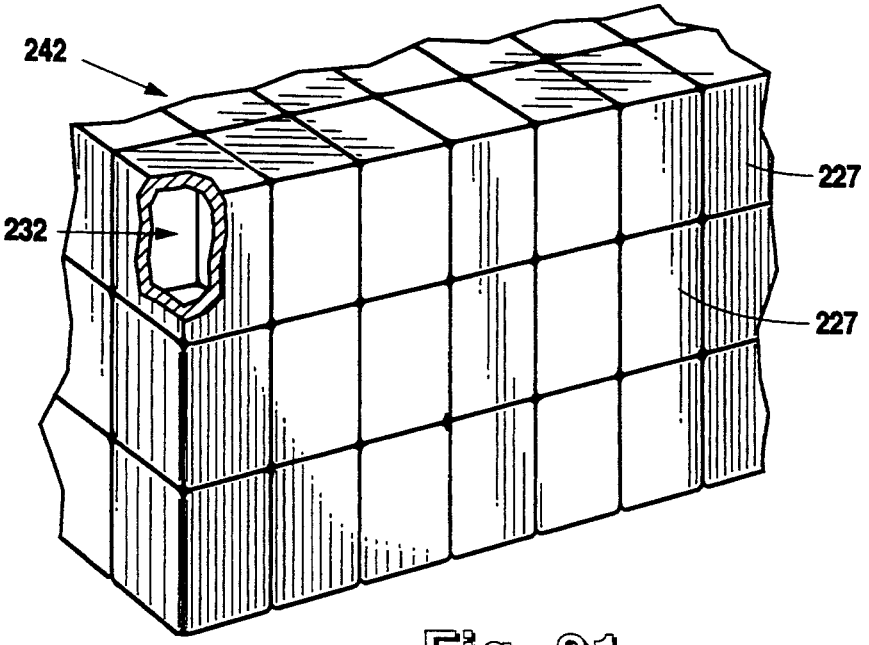
FIG. 21 is a perspective view in partial cross-section depicting a stacked array of the articles according to the first exemplary geometric shape.

As known to those skilled in the art the articles 224 may be formed in various geometric shapes. However, for the preferred embodiment of the present invention, square or rectangular geometric shapes are favored because they are capable of being stacked uniformly so that, when shipped, dunnage material 232 takes up only a relatively small volume. Thus, the preferred shape of article 224 is cubical structure 227 shown in FIGS. 16, 17 and 19. As shown in FIG. 21, a plurality cubical structures 227 may be uniformly stacked for shipment in the high density configuration of array 242. That allows the dunnage material 223 to be shipped to the user in a smaller, less bulky form. As previously described, cubical structures 227 each have an internal void 232. When any of the different geometric structures utilized to implement the dunnage material of the present invention are used for packing object 222 in a container 220, they are not uniformly stacked as shown in FIG. 21 but, instead, are haphazardly oriented as shown in FIG. 15.

Although the present invention has been described in conjunction with the foregoing preferred embodiment, other alternatives, variations, and modifications will be apparent to those skilled in the art. Those alternatives, variations, and modifications are intended to fall within the spirit and scope of the appended claims.

We claim:

1. A method for forming articles from a pulped paper slurry, comprising the steps of:

pumping said slurry into a plurality of molds;

coupling said plurality of molds to a vacuum source;

injecting compressed air into said slurry contained within each of said plurality of molds to force water from said slurry to said vacuum source and to expand said slurry to the shape of said molds, thereby forming a void within;

maintaining the coupling of said plurality of molds to said vacuum source after the injection of compressed air ceases to allow additional water to flow from said slurry to said vacuum source, thereby drying said expanded slurry into said articles;

uncoupling said plurality of molds from said vacuum source; and injecting compressed air into each of said plurality of molds to propel said articles from said plurality of molds.

* * * * *